US012357024B2

(12) United States Patent
Aller et al.

(10) Patent No.: US 12,357,024 B2
(45) Date of Patent: Jul. 15, 2025

(54) AEROSOL DELIVERY DEVICE WITH STATIC IGNITOR CONTACTS

(71) Applicant: R.J. Reynolds Tobacco Company, Winston-Salem, NC (US)

(72) Inventors: Jared Aller, Winston-Salem, NC (US); Thaddeus Jackson, Summerfield, NC (US); Karen H. Cleckley, Kernersville, NC (US); Daniel W. Rennecker, Naperville, IL (US); Matthew J. Nettenstrom, Bartlett, IL (US); Steven M. Schennum, Plainfield, IL (US)

(73) Assignee: R. J. REYNOLDS TOBACCO COMPANY, Winston-Salem, NC (US)

( * ) Notice: Subject to any disclaimer, the term of this patent is extended or adjusted under 35 U.S.C. 154(b) by 373 days.

(21) Appl. No.: 17/899,026

(22) Filed: Aug. 30, 2022

(65) Prior Publication Data

US 2024/0065323 A1 Feb. 29, 2024

(51) Int. Cl.
*A24F 40/42* (2020.01)
*A24D 1/22* (2020.01)
(Continued)

(52) U.S. Cl.
CPC ..... *A24F 40/42* (2020.01); *A24D 1/22* (2020.01); *A24F 7/02* (2013.01); *A24F 40/50* (2020.01); *A24F 40/60* (2020.01)

(58) Field of Classification Search
None
See application file for complete search history.

(56) References Cited

U.S. PATENT DOCUMENTS 1,464,300 A 8/1923 Taff
1,505,655 A 8/1924 Marek
(Continued)

FOREIGN PATENT DOCUMENTS

EP 3 862 631 A1 8/2021
EP 4 275 519 A1 11/2023
(Continued)

OTHER PUBLICATIONS

International Search Report issued in PCT Application No. PCT/IB2023/058498, mailed Dec. 21, 2023, 5 pages.

*Primary Examiner* — Michael H. Wilson
*Assistant Examiner* — Daniel Edward Vakili
(74) *Attorney, Agent, or Firm* — Womble Bond Dickinson (US) LLP

(57) ABSTRACT

Disclosed is an aerosol delivery device for use with removable and replaceable cartridges. The device includes a holder defining a proximal end and a distal end and a receiving chamber configured to receive the removable cartridge including an ignitable heat source. The holder defines a first aerosol passageway extending therethrough. The device includes a mouthpiece coupled to the holder and defining a second aerosol passageway extending therethrough and a pair of static ignitor contacts disposed proximate the receiving chamber and oriented to contact the ignitable heat source when the removable cartridge is secured within the receiving chamber. The device may include an access door movably coupled to the holder and configured to provide access to the receiving chamber in an open configuration and secure the cartridge for ignition when in a closed configuration.

28 Claims, 20 Drawing Sheets

(51) Int. Cl.

| | |
|---|---|
| ***A24F 7/02*** | (2006.01) |
| ***A24F 40/50*** | (2020.01) |
| ***A24F 40/60*** | (2020.01) |

(56) References Cited

U.S. PATENT DOCUMENTS 1,541,891 A 6/1925 Becker
1,607,132 A 11/1926 Kuno
1,613,545 A 1/1927 Teigen
1,941,531 A 1/1934 Blankenship
2,008,433 A 7/1935 Ashour
2,373,629 A 4/1945 Daugherty
2,455,492 A 12/1948 Jackson
2,502,831 A 4/1950 Daze
2,541,837 A 2/1951 Schroff
2,701,571 A 2/1955 Dittrich
2,711,176 A 6/1955 Vakilian
2,779,340 A 1/1957 Mansfield
2,953,136 A 9/1960 Dahly
3,155,099 A 11/1964 Minchin
3,181,538 A 5/1965 Piliego
3,685,520 A 8/1972 Chernack
4,708,151 A 11/1987 Shelar
4,714,082 A 12/1987 Banerjee et al.
4,966,171 A 10/1990 Serrano et al.
4,991,606 A 2/1991 Serrano et al.
5,040,552 A 8/1991 Schleich et al.
5,060,676 A 10/1991 Hearn et al.
5,076,296 A 12/1991 Nystrom et al.
5,159,940 A 11/1992 Hayward et al.
5,178,165 A 1/1993 DeFelice
5,240,012 A 8/1993 Ehrman et al.
5,529,078 A * 6/1996 Rehder ..... A24F 13/00 131/206
5,592,955 A 1/1997 Keritsis
5,595,577 A 1/1997 Bensalem et al.
5,692,525 A 12/1997 Counts et al.
5,845,649 A 12/1998 Saito et al.
6,006,757 A 12/1999 Lichtenberg
6,053,176 A 4/2000 Adams et al.
6,164,287 A 12/2000 White
6,311,694 B1 11/2001 Nichols et al.
6,345,625 B1 2/2002 Chew
6,371,127 B1 4/2002 Snaidr et al.
6,431,177 B1 8/2002 Sieggen et al.
6,532,965 B1 3/2003 Abhulimen et al.
6,615,843 B2 9/2003 Pera
6,748,955 B2 6/2004 Snaidr et al.
7,080,649 B2 7/2006 Hcu
7,503,330 B2 3/2009 Borschke et al.
7,600,517 B1 10/2009 Holzrichter
7,624,739 B2 12/2009 Snaidr et al.
8,061,361 B2 11/2011 Maeder et al.
8,151,803 B2 4/2012 Inagaki
8,302,611 B2 11/2012 Rowley
8,528,567 B2 9/2013 Hajaligol
8,616,217 B2 12/2013 Tsurizumi et al.
8,776,803 B2 7/2014 Tarora et al.
8,863,754 B2 10/2014 Renaud et al.
8,915,255 B2 12/2014 Poget et al.
9,078,473 B2 7/2015 Worm et al.
9,149,072 B2 10/2015 Conner et al.
9,220,301 B2 12/2015 Banerjee et al.
9,282,769 B2 3/2016 Mishra et al.
9,301,546 B2 4/2016 Thomas et al.
9,332,784 B2 5/2016 Banerjee et al.
9,439,453 B2 9/2016 Conner et al.
9,532,591 B2 1/2017 Mironov
9,549,572 B2 1/2017 Dincer et al.
9,609,893 B2 4/2017 Novak, III et al.
9,629,393 B2 4/2017 Stolz et al.
9,693,587 B2 7/2017 Plojoux
9,717,273 B2 8/2017 Poget et al.
9,730,468 B2 8/2017 Poget et al.
9,801,412 B2 10/2017 Grant
9,894,930 B2 2/2018 Bonici et al.
9,918,494 B2 3/2018 Mironov et al.
9,930,915 B2 4/2018 Worm et al.
9,943,114 B2 4/2018 Batista
9,961,939 B2 5/2018 Reevell
10,022,014 B2 7/2018 Mateos Martin et al.
10,034,493 B2 7/2018 Akiyama et al.
10,062,015 B2 8/2018 Besehanic
10,064,428 B2 9/2018 Swepston et al.
10,064,478 B2 9/2018 Brooks
10,082,015 B2 9/2018 Williams et al.
10,102,013 B2 10/2018 Preston et al.
10,111,463 B2 10/2018 Batista
10,132,009 B2 11/2018 Chou et al.
10,159,277 B2 12/2018 Bonnely
10,212,014 B2 2/2019 Qu et al.
10,212,968 B2 2/2019 Mironov et al.
10,222,015 B2 3/2019 Chien
10,262,017 B2 4/2019 Wolge
10,291,991 B2 5/2019 Shan et al.
10,301,990 B2 5/2019 De Smet et al.
10,302,018 B2 5/2019 Venter
10,312,017 B2 6/2019 Huang et al.
10,398,168 B2 9/2019 Maiwald et al.
10,470,491 B2 11/2019 Sutton et al.
10,492,526 B2 12/2019 Sampson et al.
10,524,503 B2 1/2020 Florack et al.
10,827,780 B2 11/2020 Swepston et al.
2008/0047570 A1 2/2008 Plank
2009/0065011 A1 3/2009 Maeder et al.
2011/0083674 A1 4/2011 Karpinsky
2013/0133675 A1 5/2013 Shinozaki et al.
2013/0167850 A1 7/2013 Al-Aawar
2013/0228190 A1 9/2013 Weiss et al.
2014/0048085 A1 2/2014 Cox
2015/0034100 A1 2/2015 Park et al.
2015/0040924 A1 2/2015 Mironov et al.
2015/0296882 A1 10/2015 Mironov et al.
2015/0342254 A1 12/2015 Mironov et al.
2016/0007648 A1 1/2016 Sutton et al.
2016/0007649 A1 1/2016 Sampson et al.
2016/0120216 A1 5/2016 Mironov et al.
2016/0135495 A1 5/2016 Poget et al.
2016/0174609 A1 6/2016 Mironov
2016/0192704 A1 7/2016 Bonnely
2016/0316816 A1 11/2016 Lavanchy et al.
2016/0360785 A1 12/2016 Bless et al.
2017/0000189 A1 1/2017 Mironov et al.
2017/0055577 A1 3/2017 Batista
2017/0055578 A1 3/2017 Oda et al.
2017/0164654 A1 6/2017 Ademe
2017/0196261 A1 7/2017 Borges De Couraca et al.
2017/0303585 A1 10/2017 Florack et al.
2017/0318859 A1 11/2017 Batista
2018/0000165 A1 1/2018 Liu
2018/0014571 A1 1/2018 Nakano
2018/0070640 A1 3/2018 Bessant et al.
2018/0116280 A1 5/2018 Maiwald et al.
2018/0192707 A1 7/2018 Worm et al.
2018/0317560 A1 11/2018 Shinozaki et al.
2018/0325167 A1 11/2018 Grant
2018/0368468 A1 12/2018 Mishra et al.
2019/0000135 A1 1/2019 Lavanant et al.
2019/0000141 A1 1/2019 Rojo-Calderon et al.
2019/0000142 A1 1/2019 Lavanchy et al.
2019/0014818 A1 1/2019 Saygili
2019/0014820 A1 1/2019 Malgat
2019/0014821 A1 1/2019 Batista et al.
2019/0059449 A1 2/2019 Akiyama et al.
2019/0059450 A1 2/2019 Akiyama et al.
2019/0075848 A1 3/2019 Worm et al.
2019/0124972 A1 5/2019 Nakano
2019/0124973 A1 5/2019 Nakano et al.
2019/0133176 A1 5/2019 Nakano et al.
2019/0150505 A1 5/2019 Ceppi et al.
2019/0274358 A1 9/2019 Reevell
2020/0015519 A1 1/2020 Conner et al.
2020/0060333 A1 2/2020 Sutton et al.
2020/0146349 A1 5/2020 Phillips et al.

(56) References Cited

U.S. PATENT DOCUMENTS

| | | | |
|---|---|---|---|
| 2020/0268044 | A1 | 8/2020 | Wilson |
| 2021/0015172 | A1 | 1/2021 | Conner et al. |
| 2021/0015174 | A1 | 1/2021 | Cox et al. |
| 2021/0015175 | A1 | 1/2021 | Jackson et al. |

FOREIGN PATENT DOCUMENTS

| | | | | |
|---|---|---|---|---|
| JP | 2002034543 | | 2/2002 | |
| JP | 2016-514243 | A | 5/2016 | |
| WO | WO1995034226 | | 12/1995 | |
| WO | WO1998054989 | | 12/1998 | |
| WO | WO2009022232 | | 2/2009 | |
| WO | WO2013072336 | | 5/2013 | |
| WO | WO2013083963 | | 6/2013 | |
| WO | WO2013149810 | | 10/2013 | |
| WO | WO2013189836 | | 12/2013 | |
| WO | WO2014037270 | | 3/2014 | |
| WO | WO2014156838 | | 10/2014 | |
| WO | WO2014180893 | | 11/2014 | |
| WO | WO2015097005 | | 7/2015 | |
| WO | WO2015128384 | | 9/2015 | |
| WO | WO2015151158 | | 10/2015 | |
| WO | WO2015184744 | | 12/2015 | |
| WO | WO2015197850 | | 12/2015 | |
| WO | WO2017042297 | | 3/2017 | |
| WO | WO2017108912 | | 6/2017 | |
| WO | WO2017114760 | | 7/2017 | |
| WO | WO2017115181 | | 7/2017 | |
| WO | WO2017115182 | | 7/2017 | |
| WO | WO2017115183 | | 7/2017 | |
| WO | WO2017115184 | | 7/2017 | |
| WO | WO2017115185 | | 7/2017 | |
| WO | WO2017115188 | | 7/2017 | |
| WO | WO2017115196 | | 7/2017 | |
| WO | WO-2017178930 | A1 * | 10/2017 | ..... A24D 1/22 |
| WO | WO2017207442 | | 12/2017 | |
| WO | WO2017212284 | | 12/2017 | |
| WO | WO2018170800 | | 9/2018 | |
| WO | WO2018201655 | | 11/2018 | |
| WO | WO2019010680 | | 1/2019 | |
| WO | WO2020216762 | | 10/2020 | |

* cited by examiner

AEROSOL DELIVERY DEVICE WITH STATIC IGNITOR CONTACTS

FIELD OF THE DISCLOSURE

The present disclosure relates to aerosol delivery devices and systems, such as smoking articles; and more particularly, to aerosol delivery devices and systems that utilize heat sources, such as combustible carbon-based ignition sources, for the production of an aerosol (e.g., smoking articles for purposes of yielding components of tobacco, tobacco extracts, nicotine, synthetic nicotine, non-nicotine flavoring, and other materials in an inhalable form, commonly referred to as heat-not-burn systems or electronic cigarettes). Components of such articles may be made or derived from tobacco, or those articles may be characterized as otherwise incorporating tobacco for human consumption, and which may be capable of vaporizing components of tobacco and/or other tobacco related materials to form an inhalable aerosol for human consumption.

BACKGROUND

Many smoking articles have been proposed through the years as improvements upon, or alternatives to, smoking products based upon combusting tobacco. Example alternatives have included devices wherein a solid or liquid fuel is combusted to transfer heat to tobacco or wherein a chemical reaction is used to provide such heat source. Examples include the smoking articles described in U.S. Pat. No. 9,078,473 to Worm et al., which is incorporated herein by reference in its entirety.

The point of the improvements or alternatives to smoking articles typically has been to provide the sensations associated with cigarette, cigar, or pipe smoking, without delivering considerable quantities of incomplete combustion and pyrolysis products. To this end, there have been proposed numerous smoking products, flavor generators, and medicinal inhalers which utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al.; and U.S. Pat. App. Pub. Nos. 2013/0255702 to Griffith, Jr. et al.; and 2014/0096781 to Sears et al., which are incorporated herein by reference. See also, for example, the various types of smoking articles, aerosol delivery devices and electrically powered heat generating sources referenced by brand name and commercial source in U.S. Pat. App. Pub. No. 2015/0220232 to Bless et al., which is incorporated herein by reference. Additional types of smoking articles, aerosol delivery devices and electrically powered heat generating sources referenced by brand name and commercial source are listed in U.S. Pat. App. Pub. No. 2015/0245659 to DePiano et al., which is also incorporated herein by reference in its entirety. Other representative cigarettes or smoking articles that have been described and, in some instances, been made commercially available include those described in U.S. Pat. No. 4,735,217 to Gerth et al.; U.S. Pat. Nos. 4,922,901, 4,947,874, and 4,947,875 to Brooks et al.; U.S. Pat. No. 5,060,671 to Counts et al.; U.S. Pat. No. 5,249,586 to Morgan et al.; U.S. Pat. No. 5,388,594 to Counts et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,476 to Hon; U.S. Pat. No. 7,513,253 to Kobayashi; U.S. Pat. No. 7,726,320 to Robinson et al.; U.S. Pat. No. 7,896,006 to Hamano; U.S. Pat. No. 6,772,756 to Shayan; U.S. Pat. App. Pub. No. 2009/0095311 to Hon; U.S. Pat. App. Pub. Nos. 2006/0196518, 2009/0126745, and 2009/0188490 to Hon; U.S. Pat. App. Pub. No. 2009/0272379 to Thorens et al.; U.S. Pat. App. Pub. Nos. 2009/0260641 and 2009/0260642 to Monsees et al.; U.S. Pat. App. Pub. Nos. 2008/0149118 and 2010/0024834 to Oglesby et al.; U.S. Pat. App. Pub. No. 2010/0307518 to Wang; and WO 2010/091593 to Hon, which are incorporated herein by reference.

Various manners and methods for assembling smoking articles that possess a plurality of sequentially arranged segmented components have been proposed. See, for example, the various types of assembly techniques and methodologies set forth in U.S. Pat. No. 5,469,871 to Barnes et al. and U.S. Pat. No. 7,647,932 to Crooks et al.; and U.S. Pat. App. Pub. Nos. 2010/0186757 to Crooks et al.; 2012/0042885 to Stone et al., and 2012/00673620 to Conner et al.; each of which is incorporated by reference herein in its entirety.

Certain types of cigarettes that employ carbonaceous fuel elements have been commercially marketed under the brand names "Premier," "Eclipse" and "Revo" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000). Additionally, a similar type of cigarette has been marketed in Japan by Japan Tobacco Inc. under the brand name "Steam Hot One."

In some instances, some smoking articles, particularly those that employ a traditional paper wrapping material, are also prone to scorching of the paper wrapping material overlying an ignitable fuel source, due to the high temperature attained by the fuel source in proximity to the paper wrapping material. This can reduce enjoyment of the smoking experience for some consumers and can mask or undesirably alter the flavors delivered to the consumer by the aerosol delivery components of the smoking articles. In further instances, traditional types of smoking articles can produce relatively significant levels of gasses, such as carbon monoxide and/or carbon dioxide, during use (e.g., as products of carbon combustion). In still further instances, traditional types of smoking articles may suffer from poor performance with respect to aerosolizing the aerosol forming component(s).

As such, it would be desirable to provide smoking articles that address one or more of the technical problems sometimes associated with traditional types of smoking articles. In particular, it would be desirable to provide a smoking article that is easy to use and that provides reusable and/or replaceable components.

BRIEF SUMMARY

In various implementations, the present disclosure relates to aerosol delivery devices for use with removable and replaceable cartridges that may be loaded into the devices via an access door and positioned relative to a pair of static ignition contacts. The present disclosure includes, without limitation, the following example implementations.

Embodiment 1: An aerosol delivery device comprising a holder comprising a main body defining a proximal end and a distal end, the main body further defining a receiving chamber configured to receive a removable cartridge comprising an ignitable heat source therein and further defining a first aerosol passageway that extends through at least a portion of the main body; an access door coupled to the holder and configured to be movable between an open configuration and a closed configuration, where in the open configuration, the receiving chamber is at least partially exposed for loading of the removable cartridge; and a static ignitor contact disposed on or in the access door and oriented to contact the ignitable heat source when the removable cartridge is secured within the receiving chamber and the access door is in the closed configuration.

Embodiment 2: The aerosol delivery device of the preceding Embodiment, further comprising a power source disposed within the main body, wherein the static ignitor contact is in electrical communication with the power source when the door is in the closed configuration.

Embodiment 3: The aerosol delivery device of any one of Embodiment 1 or 2, or any combination thereof, wherein the static ignitor contact comprises a pair of static ignitor contacts oriented so as to contact the ignitable heat source at, at least two points when the removable cartridge is secured within the receiving chamber and the access door is in the closed configuration Embodiment 4: The aerosol delivery device of any of Embodiments 1 to 3, or any combination thereof, wherein the pair of static ignitor contacts are disposed on an inner surface of the access door.

Embodiment 5: The aerosol delivery device of any of Embodiments 1 to 4, or any combination thereof, wherein the holder comprises at least one electrical contact in electrical communication with the power source and configured to mate with the static ignitor contact when the access door is in the closed configuration to complete an electrical circuit.

Embodiment 6: The aerosol delivery device of any of Embodiments 1 to 5, or any combination thereof, wherein at least one of the electrical contact comprises a pogo pin.

Embodiment 7: The aerosol delivery device of any of Embodiments 1 to 6, or any combination thereof, wherein the static ignitor contact comprises an elongate body with a first contact portion disposed at a distal end thereof and configured to engage the ignitable heat source and a second contact portion disposed at a proximal end of the elongate body and configured to engage the at least one electrical contact.

Embodiment 8: The aerosol delivery device of any of Embodiments 1 to 7, or any combination thereof, further comprising an ignition switch disposed on the holder and in electrical communication with the power source and the static ignitor contact(s) when the access door is in the closed configuration, the ignition switch configured to deliver electrical current (i.e., power) to the static ignitor contacts when actuated.

Embodiment 9: The aerosol delivery device of any of Embodiments 1 to 8, or any combination thereof, further comprising a printed circuit board disposed within the holder and in electrical communication with the power source and comprising a controller.

Embodiment 10: The aerosol delivery device of any of Embodiments 1 to 9, or any combination thereof, wherein the electrical circuit is disrupted when the access door is in the open configuration (e.g., the static ignitor contacts are no longer in electrical communication with the power source).

Embodiment 11: The aerosol delivery device of any of Embodiments 1 to 10, or any combination thereof, wherein the access door is pivotably coupled to the main body.

Embodiment 12: The aerosol delivery device of any of Embodiments 1 to 11, or any combination thereof, wherein the access door is hingedly coupled to the main body.

Embodiment 13: The aerosol delivery device of any of Embodiments 1 to 12, or any combination thereof, wherein the access door is coupled to the main body via a detent hinge configured maintain the access door in at least one of the open configuration or the closed configuration.

Embodiment 14: The aerosol delivery device of any of Embodiments 1 to 13, or any combination thereof, wherein the access door sealingly engages the main body in the closed configuration.

Embodiment 15: The aerosol delivery device of any of Embodiments 1 to 14, or any combination thereof, wherein the access door further comprises an inner housing defining the receiving chamber, wherein the access door is configured to at least one of secure the cartridge within the chamber and/or orient the receiving chamber in fluid communication with the first aerosol passageway when in the closed configuration.

Embodiment 16: The aerosol delivery device of any of Embodiments 1 to 15, or any combination thereof, further comprising a latching mechanism (e.g., magnetic engagement or a snap-fit) configured to secure the access door in the closed configuration.

Embodiment 17: The aerosol delivery device of any of Embodiments 1 to 16, or any combination thereof, wherein the access door is substantially flush with an outer surface of the holder when in the closed configuration.

Embodiment 18: The aerosol delivery device of any of Embodiments 1 to 17, or any combination thereof, further comprising an actuator assembly configured to release the access door from the closed configuration.

Embodiment 19: The aerosol delivery device of any of Embodiments 1 to 18, or any combination thereof, wherein the access door includes an insert disposed therein and configured to receive the cartridge and provide thermal insulation thereto.

Embodiment 20: The aerosol delivery device of any of Embodiments 1 to 19, or any combination thereof, further comprising a biasing mechanism disposed within the holder and oriented to engage a removable cartridge secured within the receiving chamber, wherein the biasing mechanism urges the ignitable heat source portion of the cartridge into contact with the static ignitor contact when the access door is in the closed configuration.

Embodiment 21: The aerosol delivery device of any of Embodiments 1 to 20, or any combination thereof, further comprising a seal assembly disposed within the receiving chamber and configured to removably secure the removable cartridge therein. In some implementations, the seal assembly is configured to guide the cartridge into its proper orientation, with or without sealing.

Embodiment 22: The aerosol delivery device of any of Embodiments 1 to 21, or any combination thereof, further comprising a mouthpiece including a first end and a longitudinally opposed second end with a second aerosol passageway extending longitudinally therebetween, wherein the first end is configured to engage with a user's mouth and the second end is configured to engage the proximal end of the holder, thereby providing fluid communication between the first and second aerosol passageways for delivery of the aerosol generated in the receiving chamber to the user.

Embodiment 23: The aerosol delivery device of any of Embodiments 1 to 22, or any combination thereof, wherein the access door defines an opening in a distal end thereof, the opening may be configured to provide air/oxygen to the ignited heat source. In some implementations, the air/oxygen may travel through the heat source and/or the air/oxygen may mix with an aerosol generated by the removable cartridge and deliverable to a user via the mouthpiece.

Embodiment 24: The aerosol delivery device of any of Embodiments 1 to 23, or any combination thereof, further comprising a sliding actuator assembly coupled to the holder and configured to eject the removable cartridge.

Embodiment 25: The aerosol delivery device of any of Embodiments 1 to 24, or any combination thereof, wherein the sliding actuator assembly comprises a tubular body defining a portion of the first aerosol passageway and configured to slide along a portion of the main body in a first direction and a second direction, a first protrusion extending from an outer surface of the tubular body and configured to extend through an opening in a wall of the main body to provide for moving the tubular body in the first and second directions, and a second protrusion extending from a distal end of the tubular body and configured to engage the removable cartridge so as to advance the removable cartridge through the distal end of the main body when the tubular body is moved in the first or second direction.

Embodiment 26: The aerosol delivery device of any of Embodiments 1 to 25, or any combination thereof, wherein the actuator further comprises a sealing arrangement for sealingly engaging an internal surface of the main body.

Embodiment 27: An aerosol delivery device comprising a holder comprising a main body defining a proximal end and a distal end; a receiving compartment coupled to the holder and configured to be movable between an open configuration and a closed configuration, the receiving compartment defining a receiving chamber configured to receive a removable cartridge comprising an ignitable heat source, where in the open configuration, the receiving chamber is at least partially exposed; and a pair of static ignitor contacts disposed within the receiving compartment and oriented to contact the ignitable heat source when the removable cartridge is secured within the receiving chamber and the receiving compartment is in the closed configuration. In some implementations, the ignitable heat source may be in contact with the ignitor contacts in the open configuration prior to closing the receiving compartment. Typically, in the closed configuration, the ignitable heat source will be in optimal contact with the ignitor contacts.

Embodiment 28: The aerosol delivery device of the preceding Embodiment, further comprising a power source disposed within the main body, wherein the static ignitor contact is in electrical communication with the power source when the door is in the closed configuration.

Embodiment 29: The aerosol delivery device of any one of Embodiment 27 or 28, or any combination thereof, wherein the holder comprises at least one electrical contact in electrical communication with the power source and configured to mate with the static ignitor contacts when the receiving compartment is in the closed configuration to complete an electrical circuit.

Embodiment 30: The aerosol delivery device of any of Embodiments 27 to 29, or any combination thereof, further comprising an ignition switch disposed on the holder and in electrical communication with the power source and the static ignitor contacts, the ignition switch configured to deliver electrical current (i.e., power) to the static ignitor contacts when actuated.

Embodiment 31: The aerosol delivery device of any of Embodiments 27 to 30, or any combination thereof, further comprising a printed circuit board disposed within the holder and in electrical communication with the power source and comprising a controller.

Embodiment 32: The aerosol delivery device of any of Embodiments 27 to 31, or any combination thereof, wherein the electrical circuit is disrupted when the receiving compartment is in the open configuration.

Embodiment 33: The aerosol delivery device of any of Embodiments 27 to 32, or any combination thereof, wherein the receiving compartment is pivotably coupled to the main body.

Embodiment 34: The aerosol delivery device of any of Embodiments 27 to 33, or any combination thereof, wherein the receiving compartment sealingly engages the main body in the closed configuration.

Embodiment 35: The aerosol delivery device of any of Embodiments 27 to 34, or any combination thereof, wherein the main body further defines a first aerosol passageway that extends through at least a portion of the main body.

Embodiment 36: The aerosol delivery device of any of Embodiments 27 to 35, or any combination thereof, wherein the receiving compartment further comprises an inner housing defining the receiving chamber, wherein the receiving compartment is configured to secure the cartridge and/or orient the receiving chamber in fluid communication with first aerosol passageway when in the closed configuration.

Embodiment 37: The aerosol delivery device of any of Embodiments 27 to 36, or any combination thereof, further comprising a latching mechanism configured to secure the receiving compartment in the closed configuration.

Embodiment 38: The aerosol delivery device of any of Embodiments 27 to 37, or any combination thereof, wherein the receiving compartment (e.g., at least a portion of an outer surface thereof) is substantially flush with an outer surface of the holder when in the closed configuration.

Embodiment 39: The aerosol delivery device of any of Embodiments 27 to 38, or any combination thereof, wherein the receiving compartment includes an insert disposed therein and configured to receive the cartridge and provide thermal insulation thereto.

Embodiment 40: The aerosol delivery device of any of Embodiments 27 to 39, or any combination thereof, further comprising a biasing mechanism disposed within the holder and oriented to engage a removable cartridge secured within the receiving chamber, wherein the biasing mechanism urges the ignitable heat source of the cartridge into contact with the static ignitor contacts when the receiving compartment is in the closed configuration.

Embodiment 41: The aerosol delivery device of any of Embodiments 27 to 40, or any combination thereof, further comprising a mouthpiece including a first end and a longitudinally opposed second end with a second aerosol passageway extending longitudinally therebetween, wherein the first end is configured to engage with a user's mouth and the second end is configured to engage the proximal end of the holder to, for example, provide fluid communication between the first and second aerosol passageways for delivery of an aerosol generated in the receiving chamber to the user.

Embodiment 42: The aerosol delivery device of any of Embodiments 27 to 41, or any combination thereof, wherein the receiving compartment defines an opening in a distal end thereof, the opening may be configured to provide air/oxygen to the ignited heat source. In some implementations, the air/oxygen may travel through the heat source and/or the air/oxygen may mix with an aerosol generated by the removable cartridge and deliverable to a user via the mouthpiece.

Embodiment 43: An aerosol delivery device comprising a holder comprising a main body defining a proximal end and a distal end, the main body further defining a receiving chamber configured to receive a removable cartridge comprising an ignitable heat source and a first aerosol passageway that extends through at least a portion of the main body; an access door coupled to the holder and configured to be movable between an open configuration and a closed configuration, wherein in the open configuration, the receiving chamber is at least partially exposed; a pair of static ignitor contacts at least partially disposed within the receiving chamber and oriented to receive the ignitable heat source therebetween to secure the removable cartridge within the receiving chamber; and an ejector assembly coupled to the holder and configured to release the removable cartridge.

Embodiment 44: The aerosol delivery device of the preceding Embodiment, wherein the ejector assembly comprises an inclined or wedge shaped body having a leading edge, wherein the leading edge is oriented so as to be inserted between each of the ignitor contacts of the pair of static ignitor contacts so as to deflect the ignitor contacts outwardly when the ejector assembly is advanced towards the distal end of the main body, thereby releasing the cartridge.

Embodiment 45: The aerosol delivery device of any of Embodiments 43 or 44, or any combination thereof, wherein a spring force from the deflected ignitor contacts returns the ejector assembly to a neutral position once the ejector is released. For example, after the cartridge is removed or otherwise advanced beyond the ignitor contacts, the spring force is sufficient to push the wedge out from between the ignitor contacts after the force applied to the ejector is removed.

Embodiment 46: The aerosol delivery device of any of Embodiments 43 to 45, or any combination thereof, further comprising a power source disposed within the main body, wherein the static ignitor contacts are in electrical communication with the power source.

Embodiment 47: The aerosol delivery device of any of Embodiments 43 to 46, or any combination thereof, further comprising an ignition switch disposed on the holder and in electrical communication with the power source and the static ignitor contacts, the ignition switch configured to deliver electrical current to the static ignitor contacts when actuated.

Embodiment 48: The aerosol delivery device of any of Embodiments 43 to 47, or any combination thereof, further comprising a printed circuit board disposed within the holder and in electrical communication with the power source and comprising a controller.

Embodiment 49: The aerosol delivery device of any of Embodiments 43 to 48, or any combination thereof, wherein the pair of static ignitor contacts are coupled to the printed circuit board.

Embodiment 50: The aerosol delivery device of any of Embodiments 43 to 49, or any combination thereof, wherein each of the pair of static ignitor contacts comprises an elongate body with a first contact portion disposed at a distal end thereof and configured to engage the ignitable heat source and a second contact portion disposed at a proximal end of the elongate body and configured to engage the printed circuit board.

Embodiment 51: The aerosol delivery device of any of Embodiments 43 to 50, or any combination thereof, wherein each of the pair of static ignitor contacts comprises a spring component (e.g., a bend in the elongate body) configured to enable the static ignitor contacts to deflect when contacted by another object (e.g., the cartridge or the ejector).

Embodiment 52: The aerosol delivery device of any of Embodiments 43 to 51, or any combination thereof, wherein the printed circuit board further comprises a charging port and the printed circuit board is oriented within the holder so that the charging port is disposed at one end of the holder.

Embodiment 53: The aerosol delivery device of any of Embodiments 43 to 52, or any combination thereof, further comprising an inner housing disposed within the main body of the holder and further defining the receiving chamber, wherein the inner housing is configured to house one or more of a power source, a printed circuit board, and the ejector assembly therein.

Embodiment 54: The aerosol delivery device of any of Embodiments 43 to 53, or any combination thereof, wherein the access door is slidably coupled to the main body.

Embodiment 55: The aerosol delivery device of any of Embodiments 43 to 54, or any combination thereof, further comprising a mouthpiece including a first end and a longitudinally opposed second end with a second aerosol passageway extending longitudinally therebetween, wherein the first end is configured to engage with a user's mouth and the second end is configured to engage the proximal end of the holder to, for example, provide fluid communication between the first and second aerosol passageways for delivery of an aerosol generated in the receiving chamber to the user.

Embodiment 56: An aerosol delivery device comprising a holder having a main body defining a proximal end and a distal end, the main body further defining a receiving chamber configured to receive a removable cartridge and a first aerosol passageway that extends through at least a portion of the main body, and a mouthpiece assembly comprising a mouthpiece including a first end configured to engage with a user's mouth and a longitudinally opposed second end configured to engage the proximal end of the holder with a second aerosol passageway extending between the first and second ends, wherein a central longitudinal axis of the second aerosol passageway is offset from a central longitudinal axis of the first aerosol passageway and the first and second aerosol passageways define a unitary offset vapor path from the distal end of the main body to the first end of the mouthpiece for passing an aerosol generated from the removable cartridge to a user.

Embodiment 57: The aerosol delivery device of the preceding embodiment, wherein the mouthpiece assembly further comprises an insert at least partially disposed within a recess formed within the second end of the mouthpiece and defining a third aerosol passageway configured to fluidly couple the first aerosol passageway and the second aerosol passageway.

Embodiment 58: The aerosol delivery device of any of Embodiments 56 or 57, or any combination thereof, further comprising an access door assembly sealingly coupled to the main body and defining the receiving chamber, wherein the access door assembly is movable between an open configuration providing access to the receiving chamber for loading the removable cartridge therein and a closed configuration securing the cartridge in fluid communication with the first aerosol passageway.

Embodiment 59: The aerosol delivery device of any of Embodiments 56 to 58, or any combination thereof, wherein the access door assembly is pivotably coupled to the holder.

Embodiment 60: The aerosol delivery device of any of Embodiments 1 to 59, or any combination thereof, wherein the mouthpiece is removable.

Embodiment 61: The aerosol delivery device of any of Embodiments 1 to 60, or any combination thereof, further comprising the removable cartridge, wherein the cartridge includes a substrate material having an aerosol precursor composition configured to form an aerosol upon application of heat thereto.

Embodiment 62: The aerosol delivery device of any of Embodiments 1 to 61, or any combination thereof, wherein the holder comprises a window disposed therein and configured to provide a view of at least a portion of the removable cartridge.

These and other features, aspects, and advantages of the disclosure will be apparent from a reading of the following detailed description together with the accompanying drawings, which are briefly described below. The invention includes any combination of two, three, four, or more of the above-noted embodiments as well as combinations of any two, three, four, or more features or elements set forth in this disclosure, regardless of whether such features or elements are expressly combined in a specific embodiment description herein. This disclosure is intended to be read holistically such that any separable features or elements of the disclosed invention, in any of its various aspects and embodiments, should be viewed as intended to be combinable unless the context clearly dictates otherwise.

BRIEF DESCRIPTION OF THE DRAWINGS

Figure 1B:
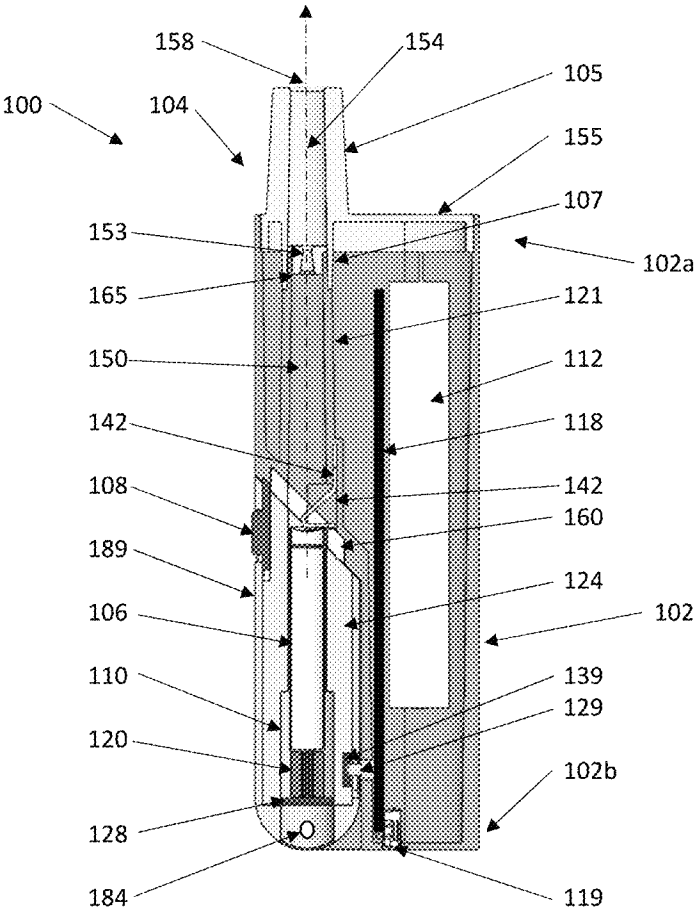
Figure 1A:
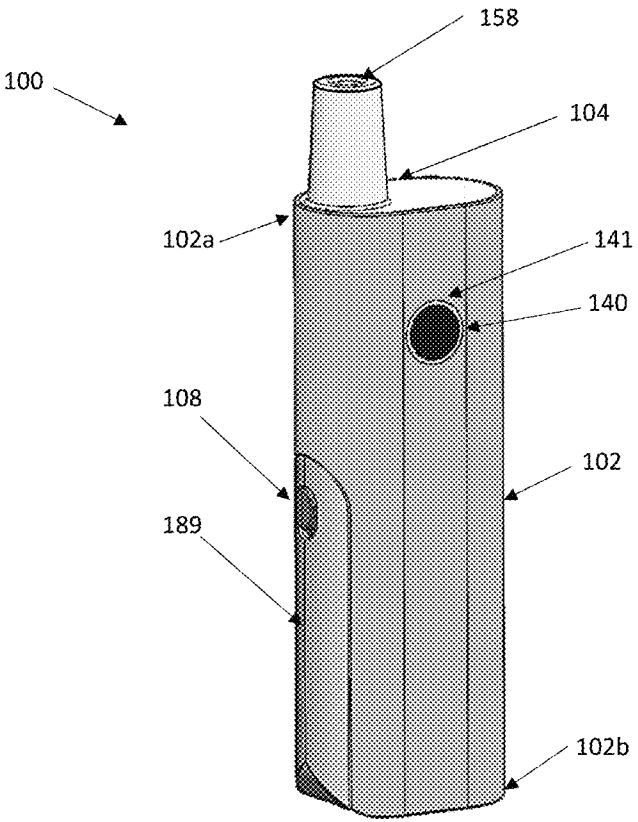
Figure 2:
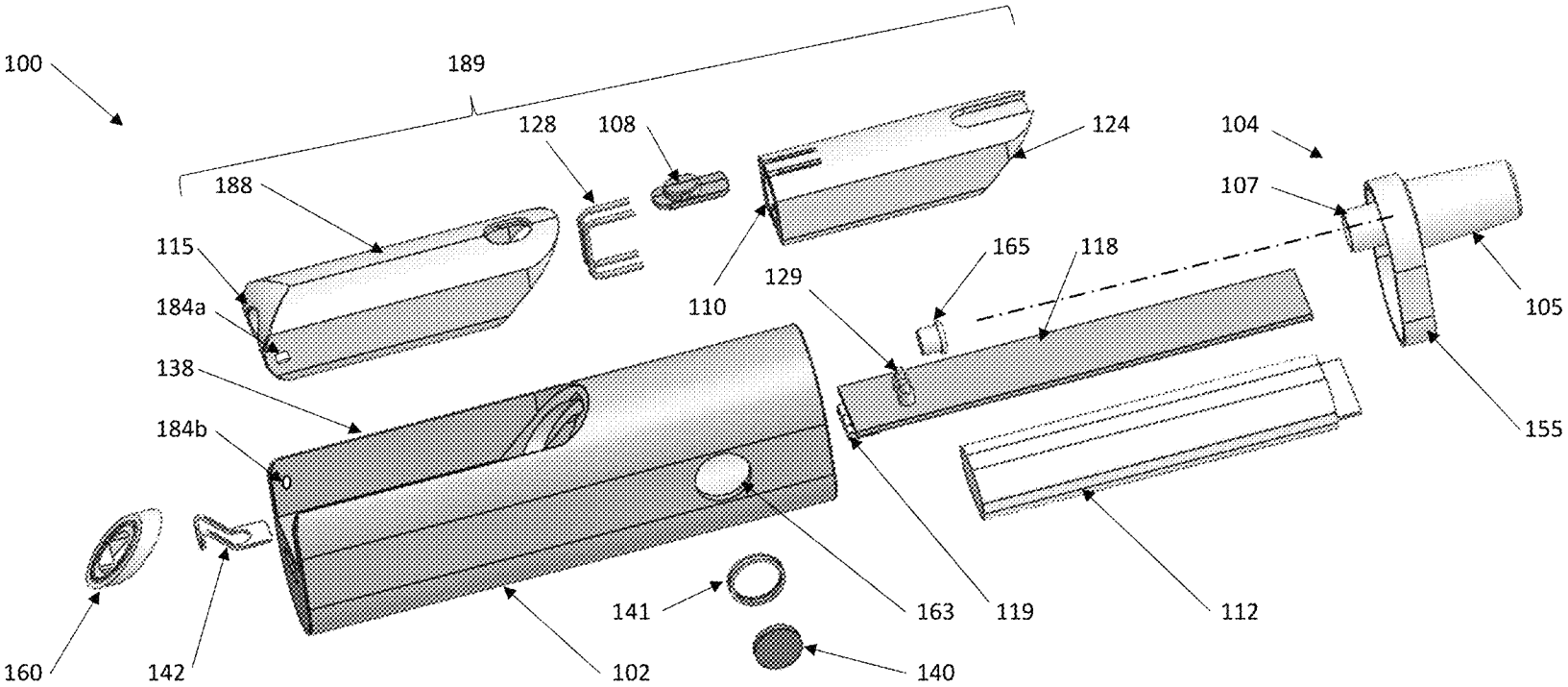
Figure 4:
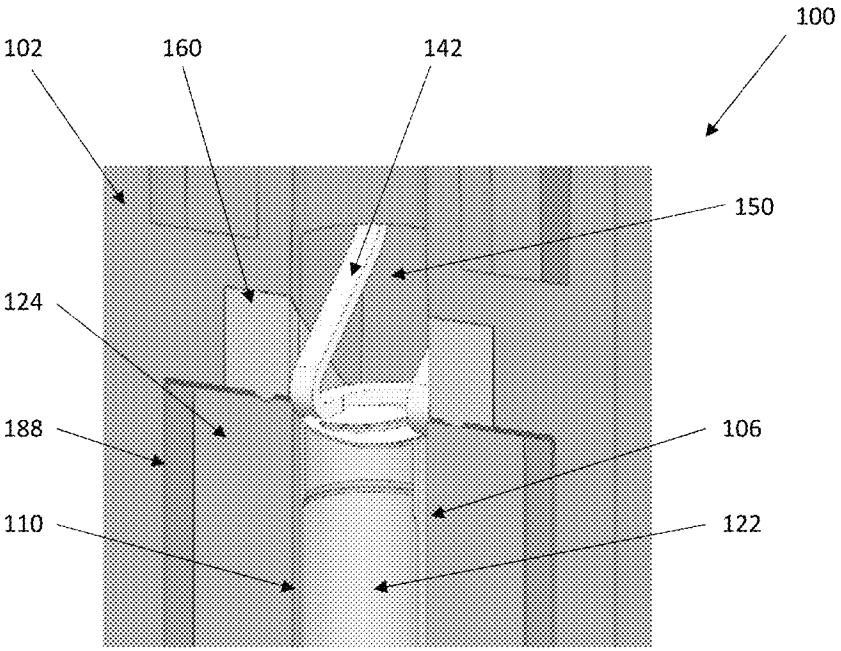
Figure 3:
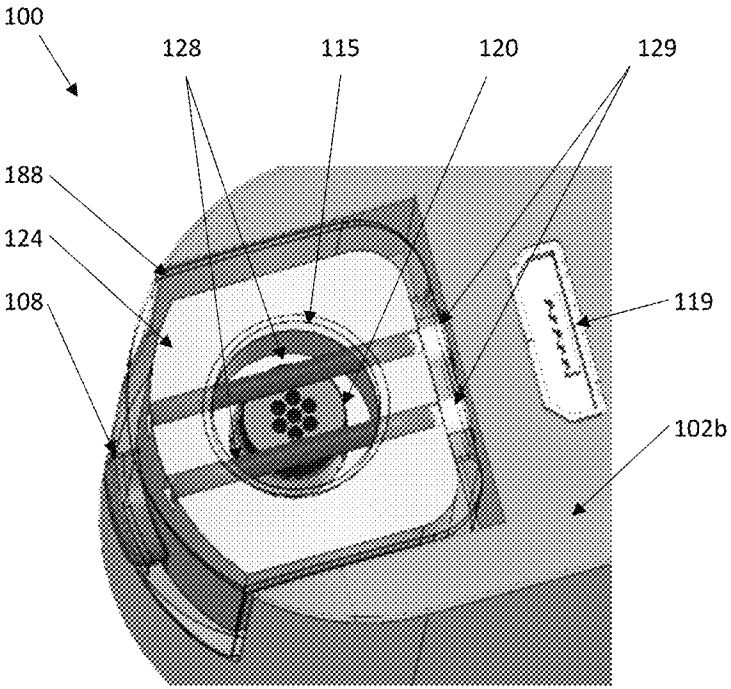
Figure 5C:
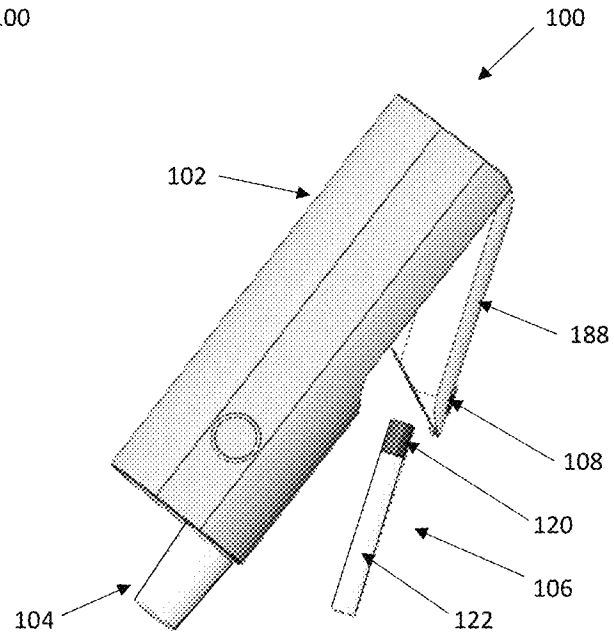
Figure 5B:
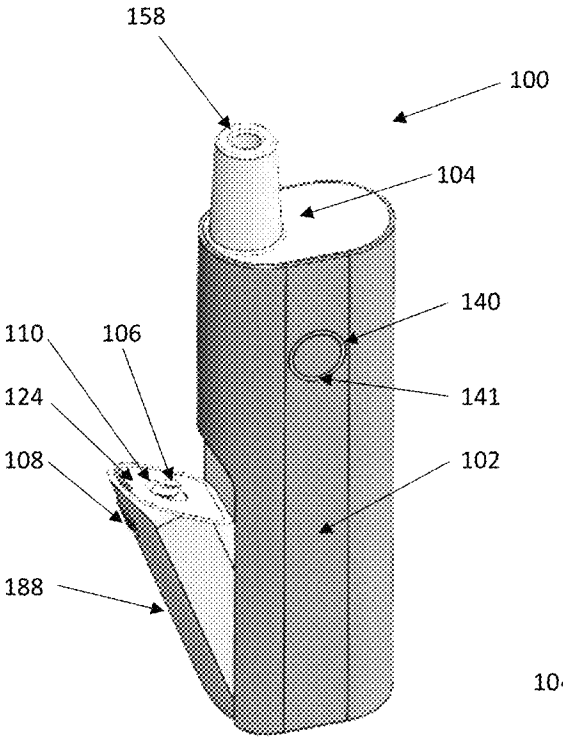
Figure 5A:
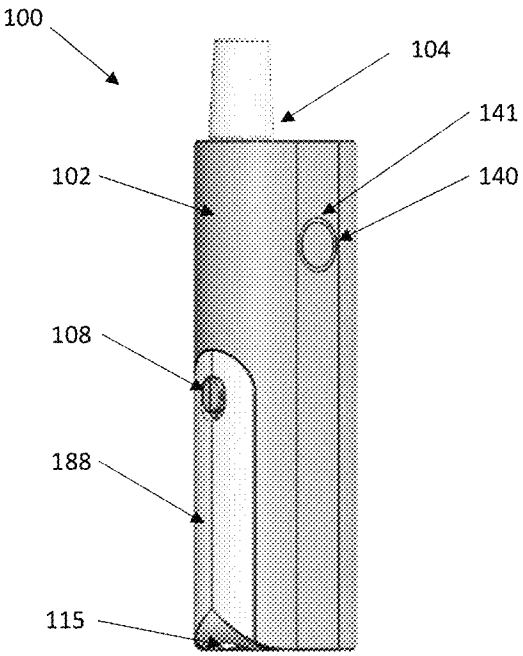
Figure 6B:
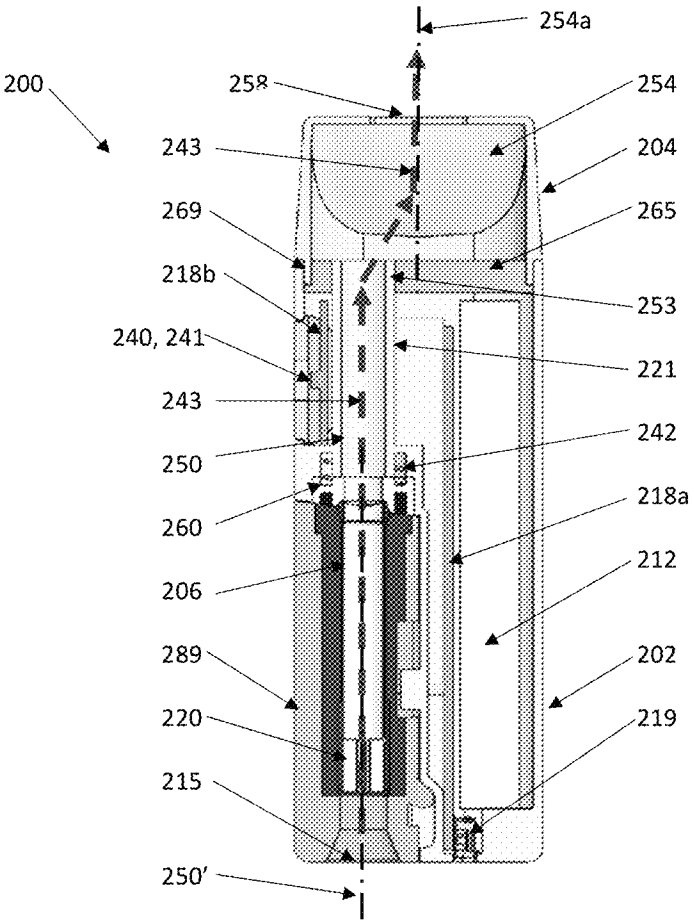
Figure 6A:
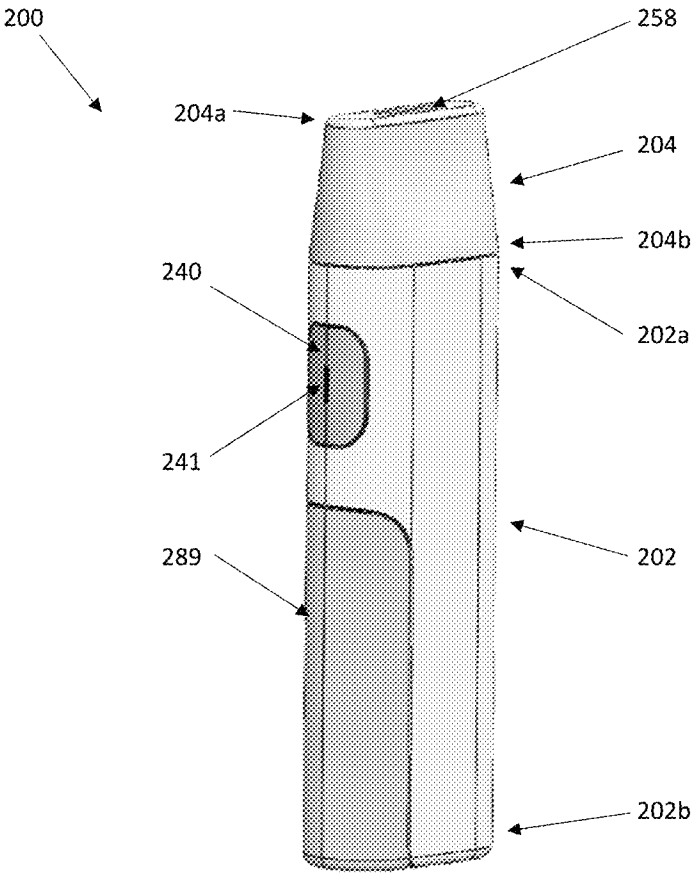
Figure 7:
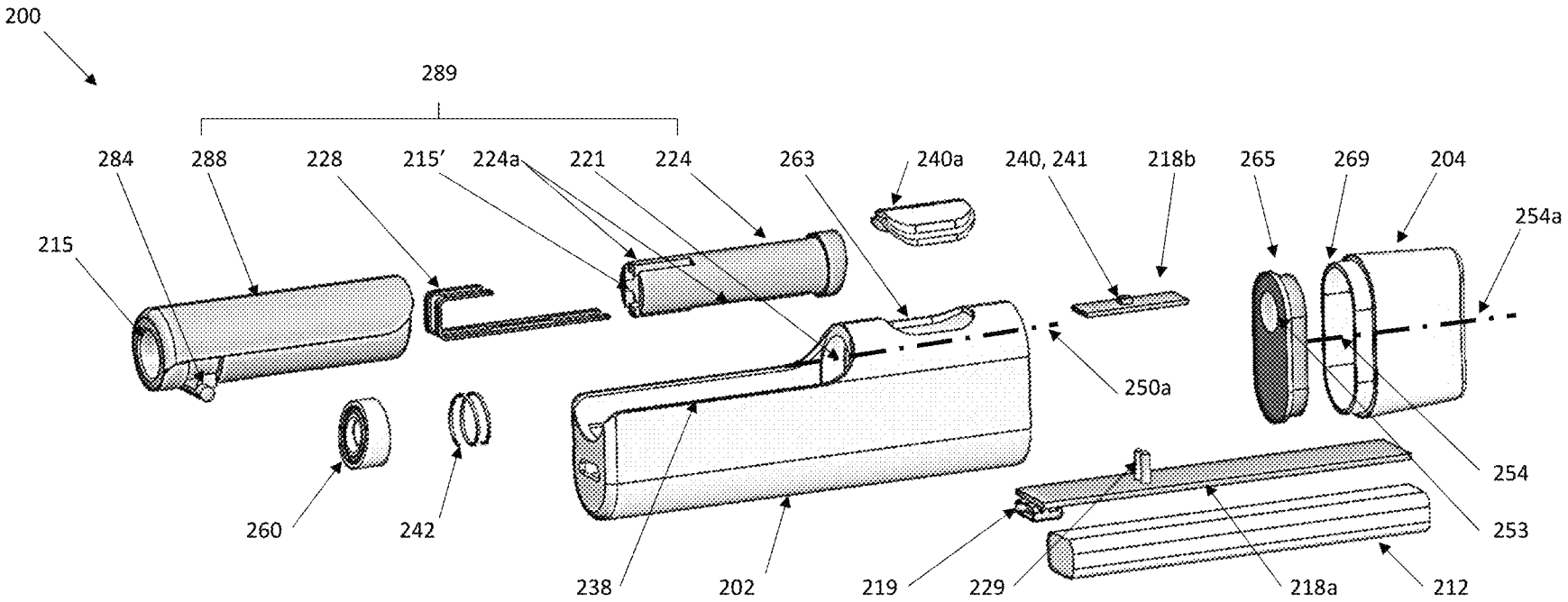
Figure 9:
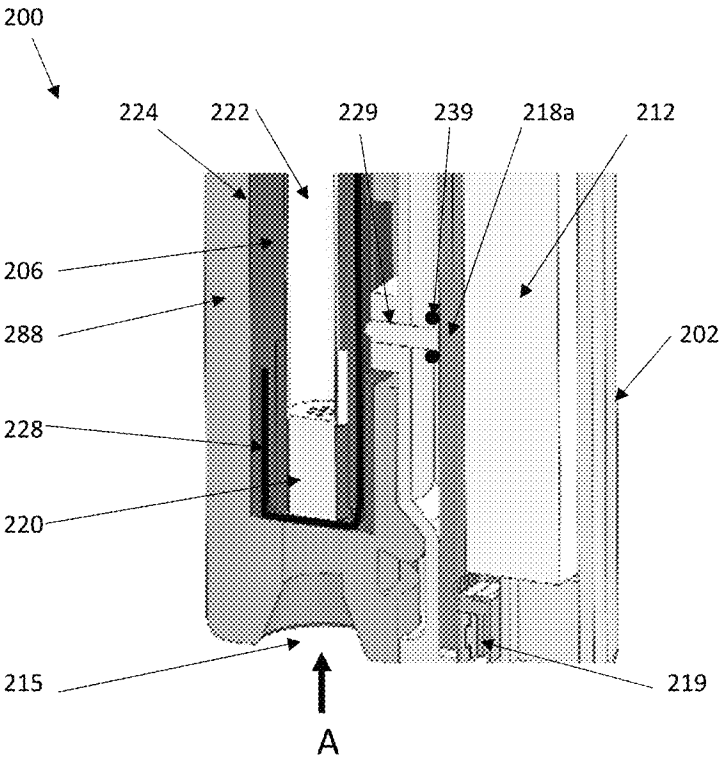
Figure 8:
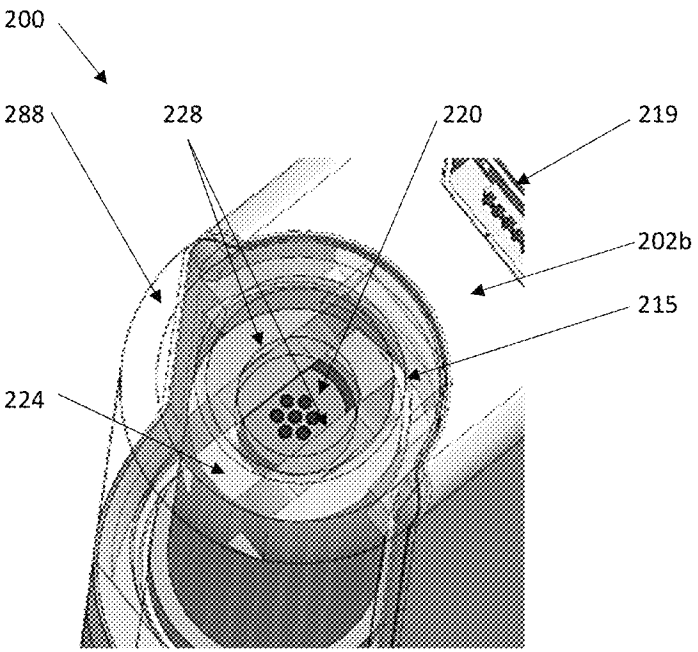
Figure 10C:
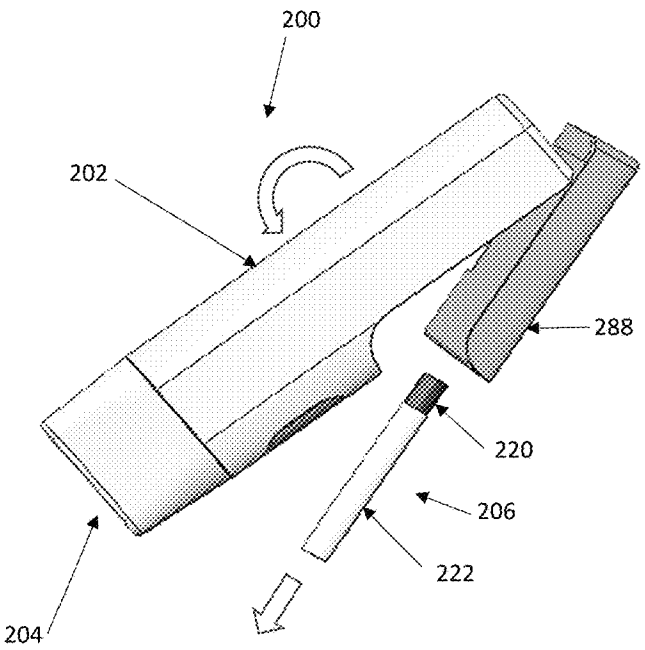
Figure 10B:
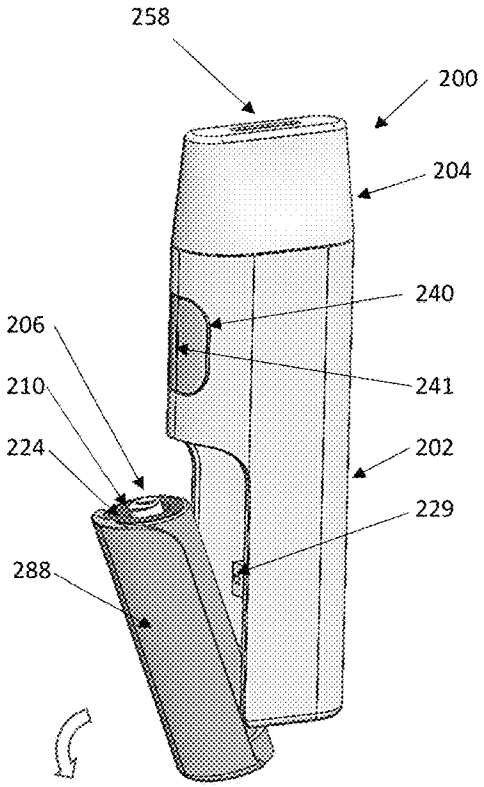
Figure 10A:
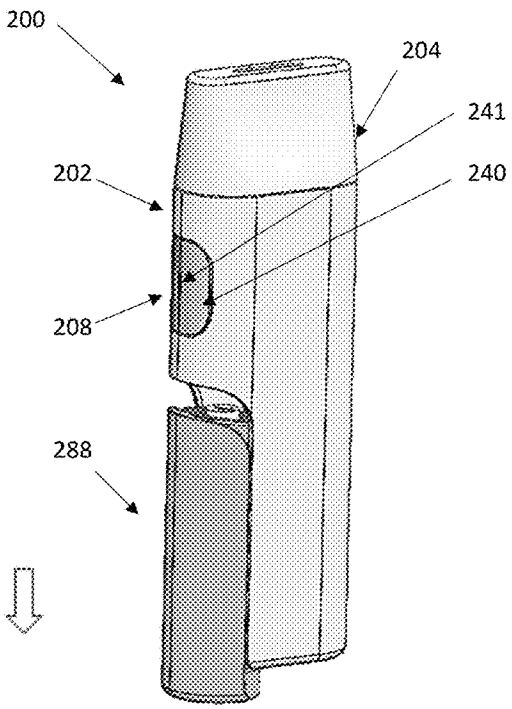
Figure 11A:
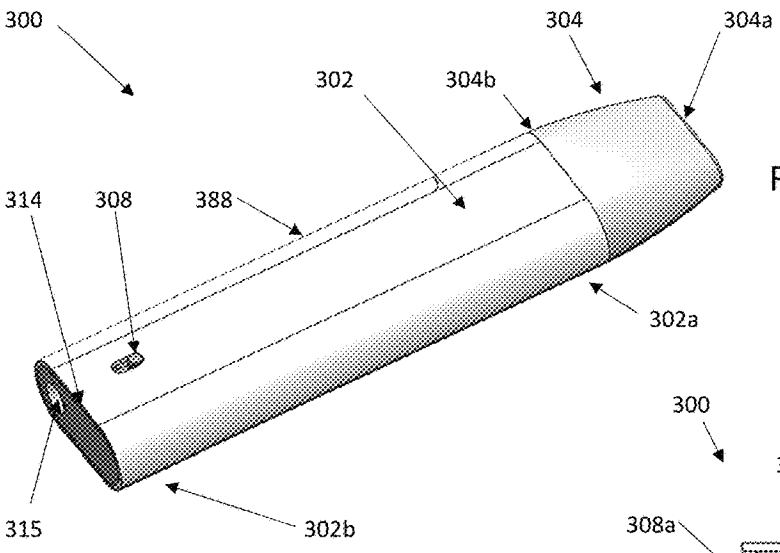
Figure 11B:
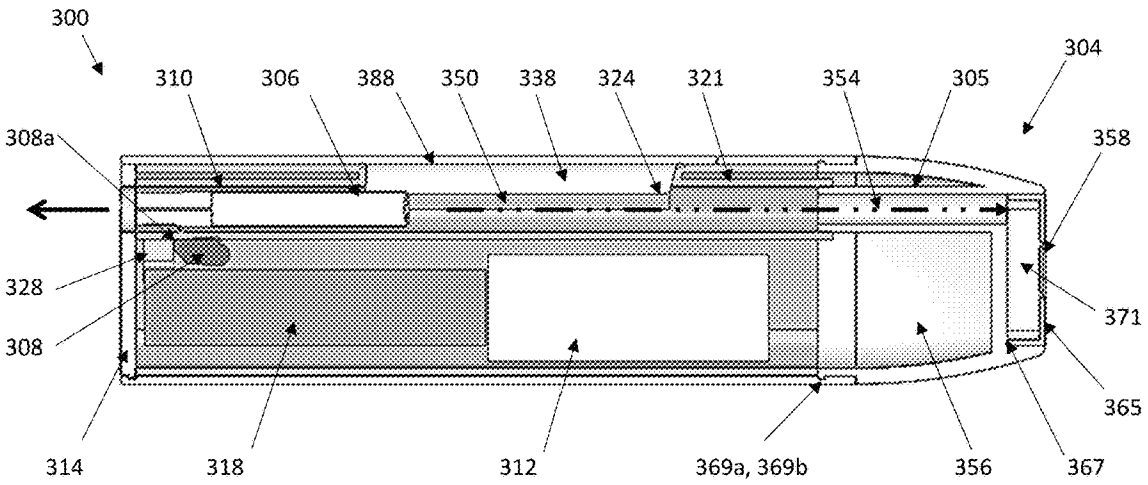
Figures 12A, 12B:
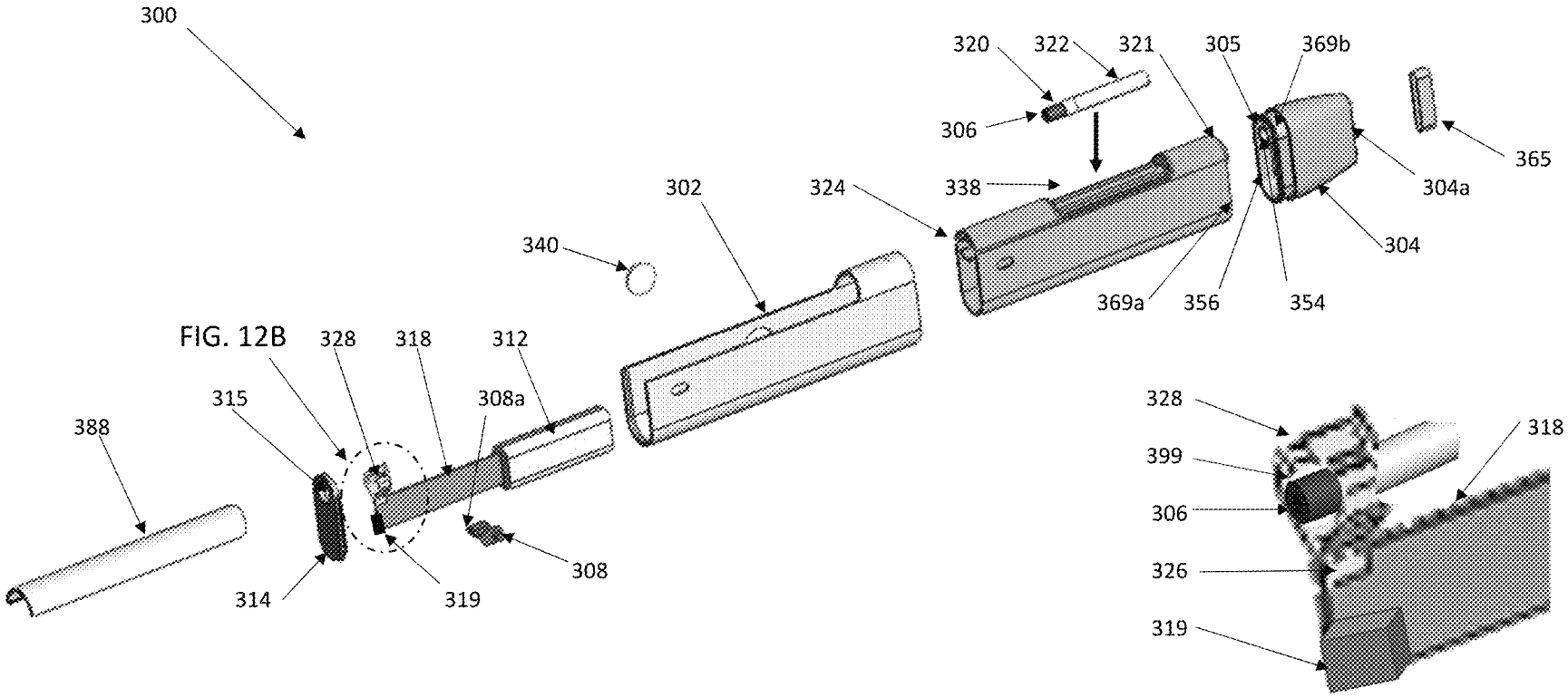
Figure 13B:
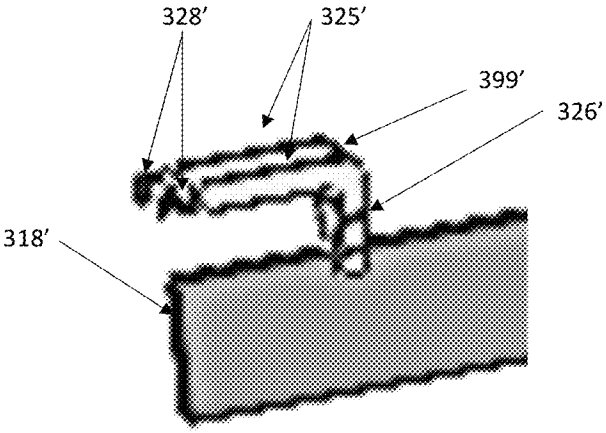
Figure 13A:
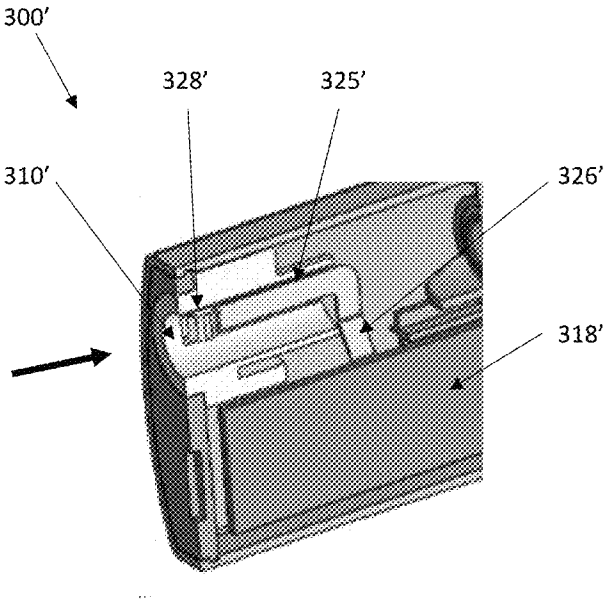
Figure 14B:
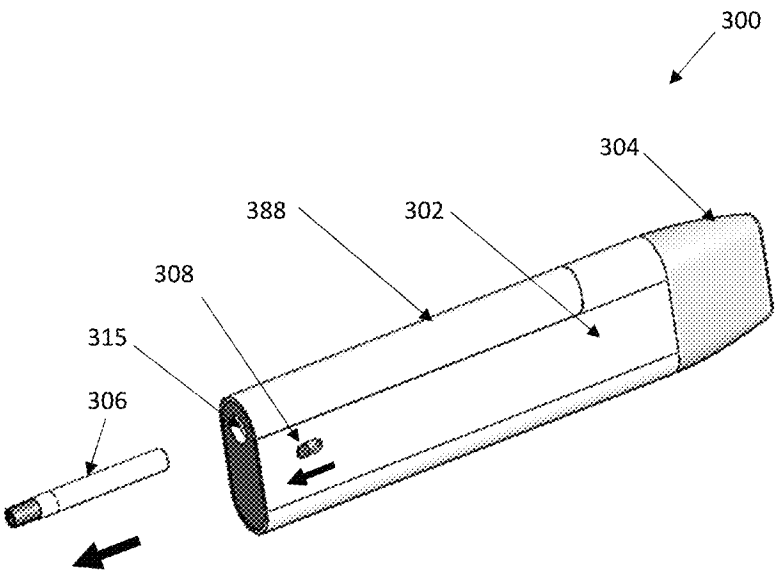
Figure 14A:
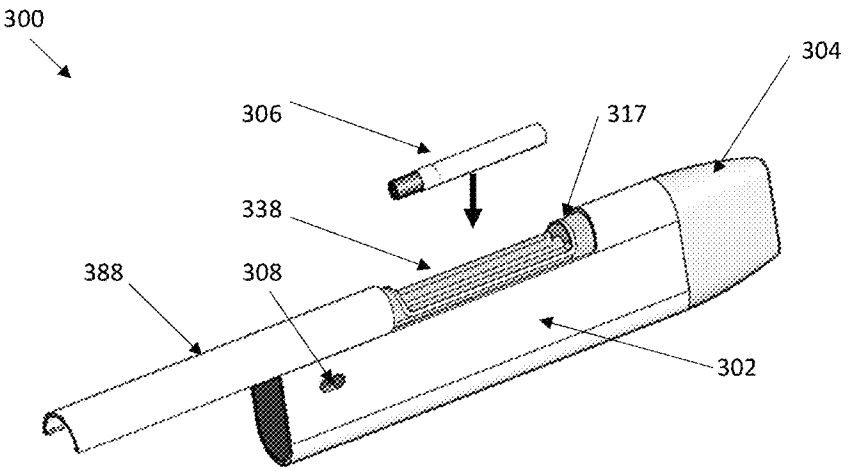
Figure 15B:
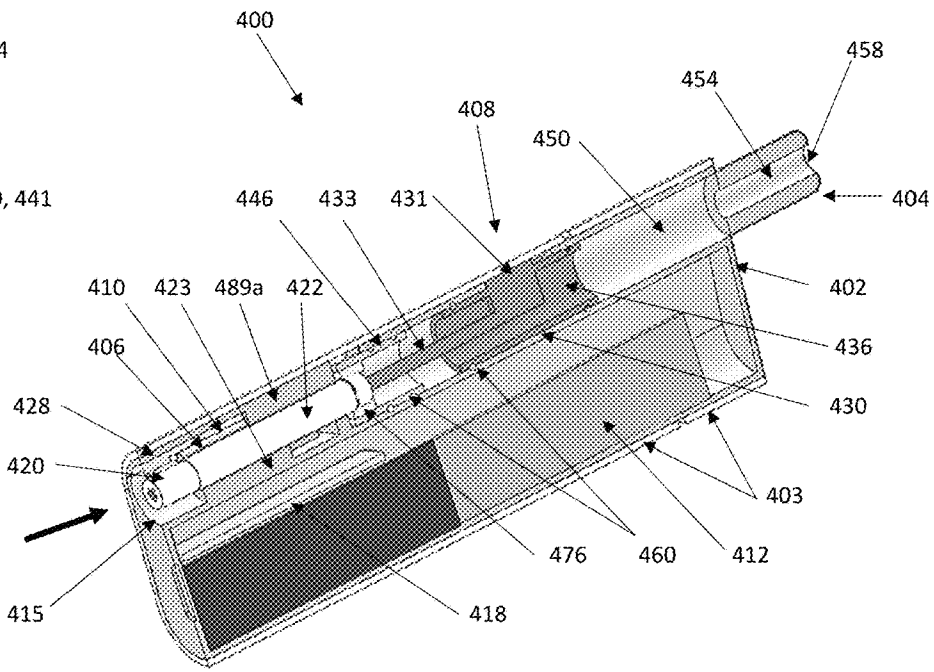
Figure 15A:
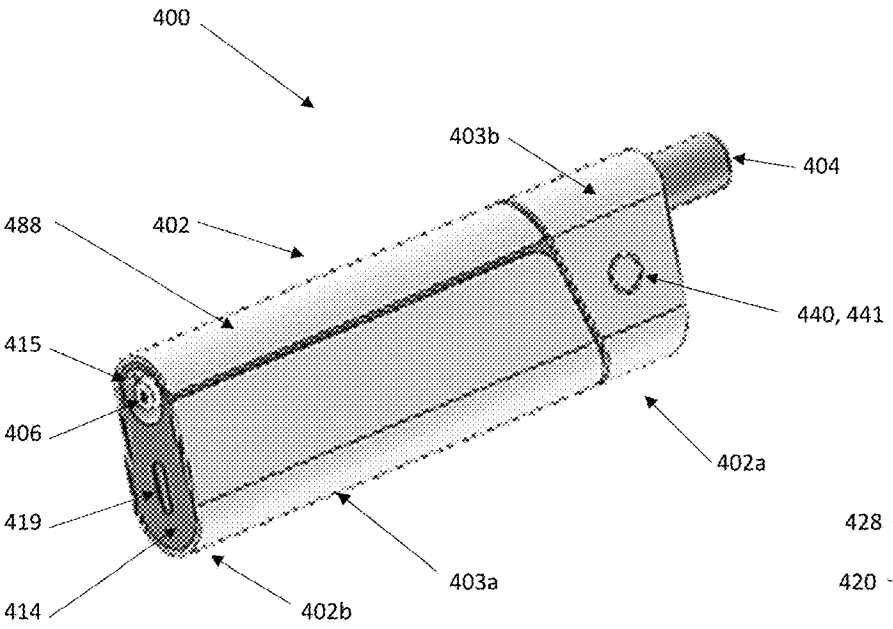
Figure 16:
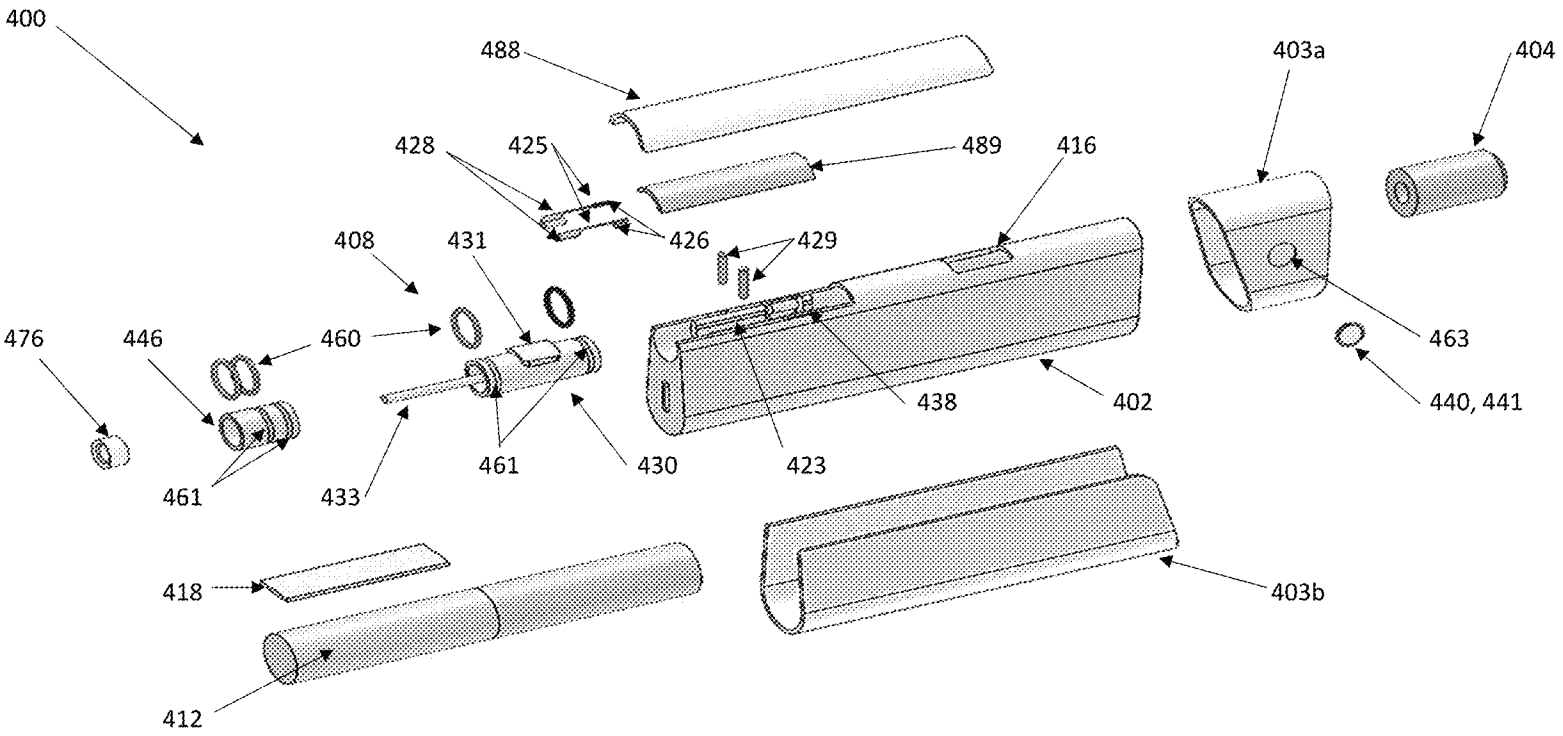
Figures 17A, 17B:
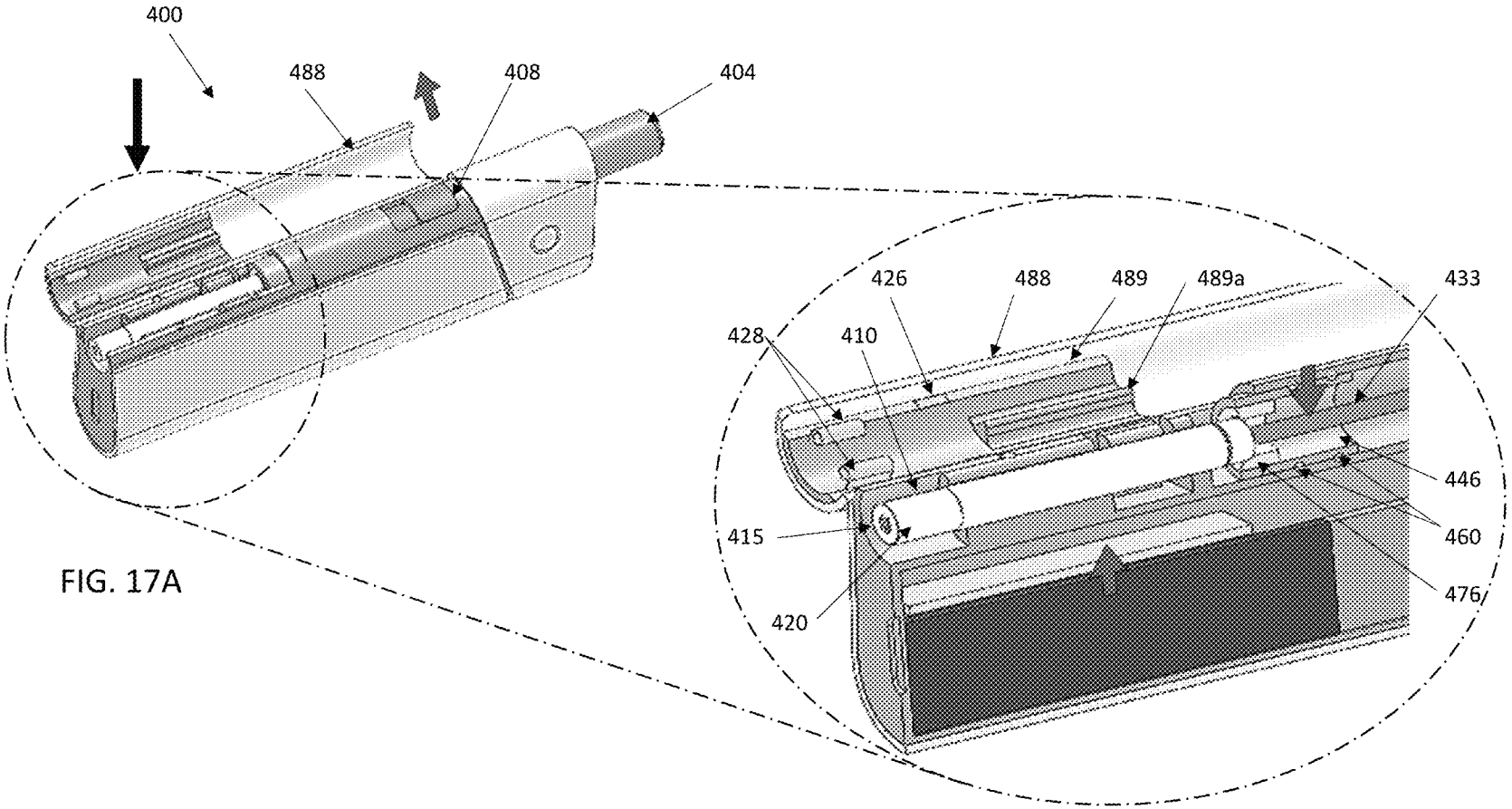
Figure 18:
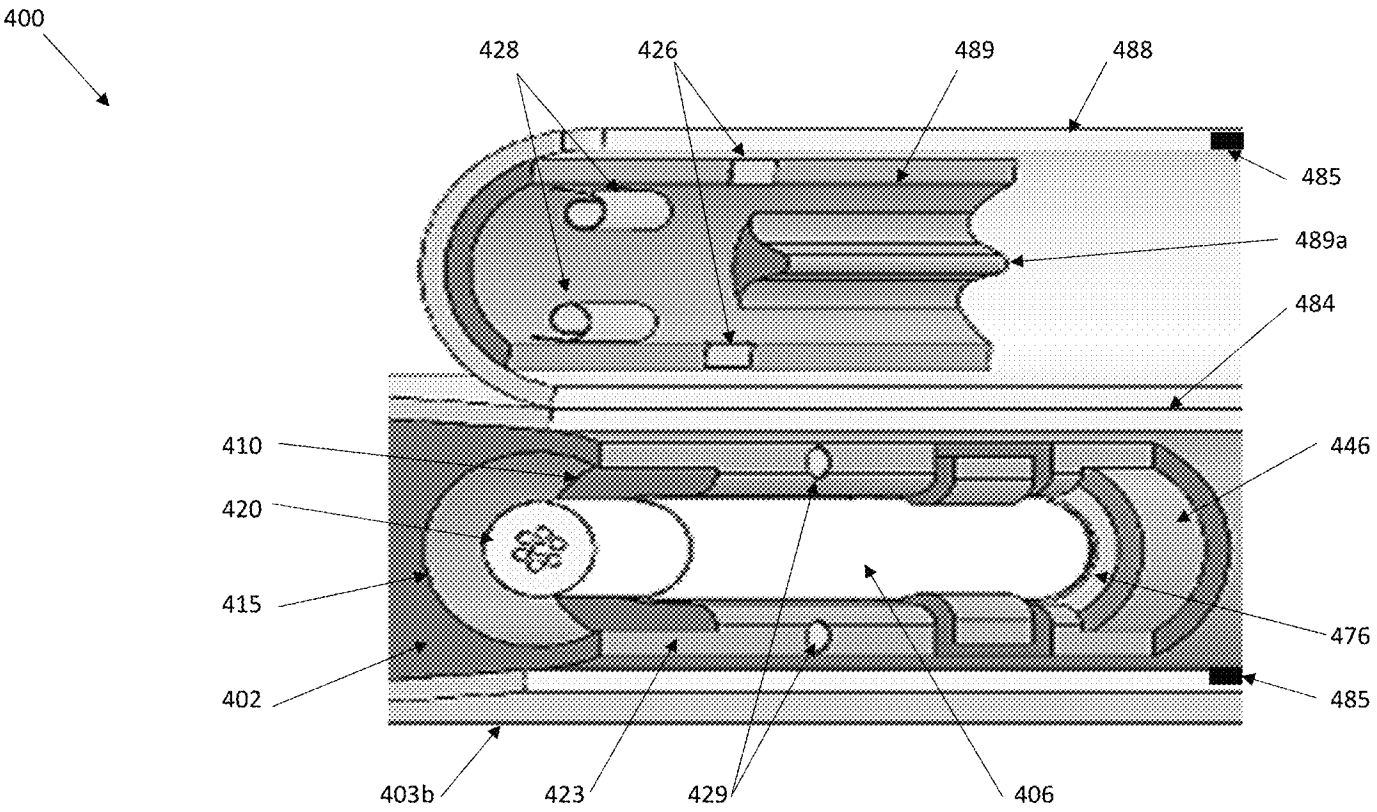
Figure 19B:
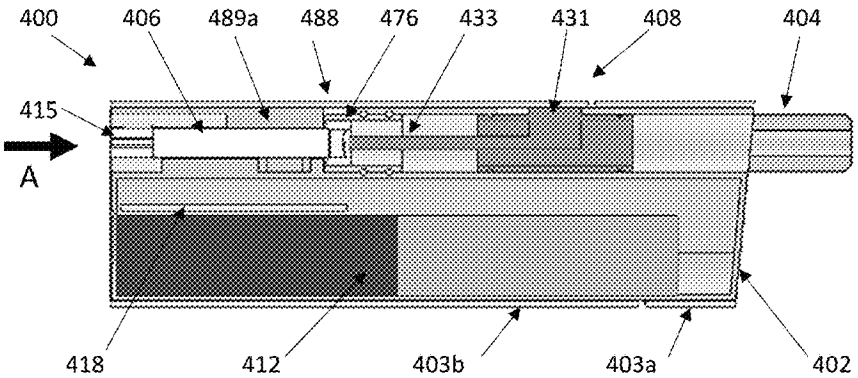
Figure 19A:
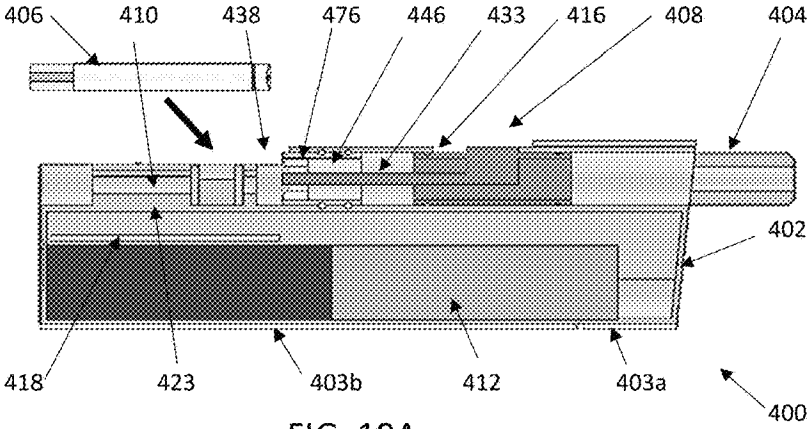
Figure 19C:
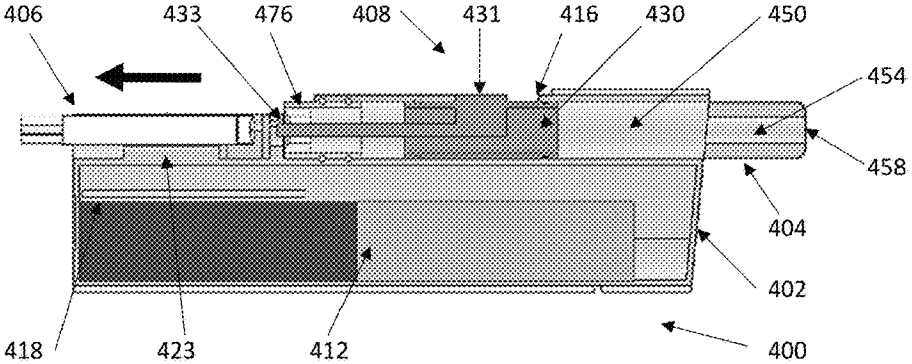
Figure 20B:
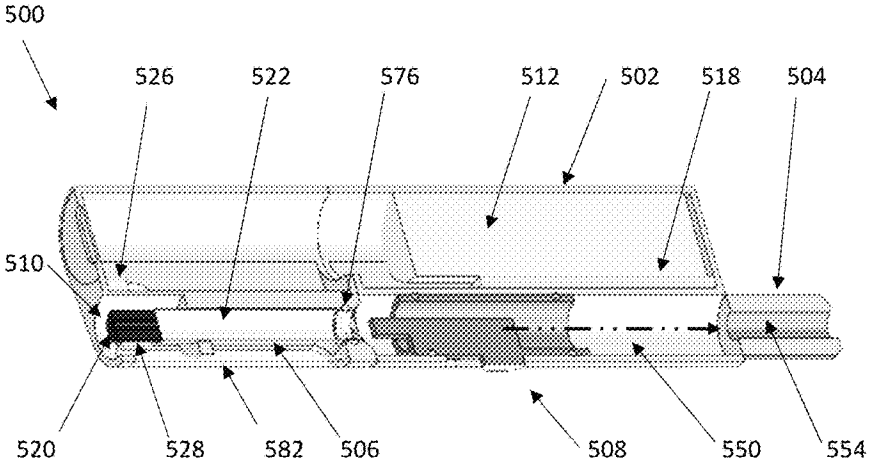
Figure 20A:
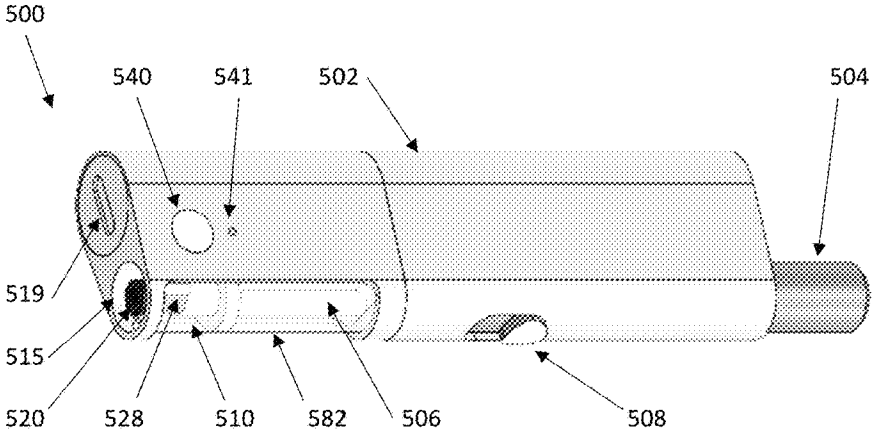
Figure 21:
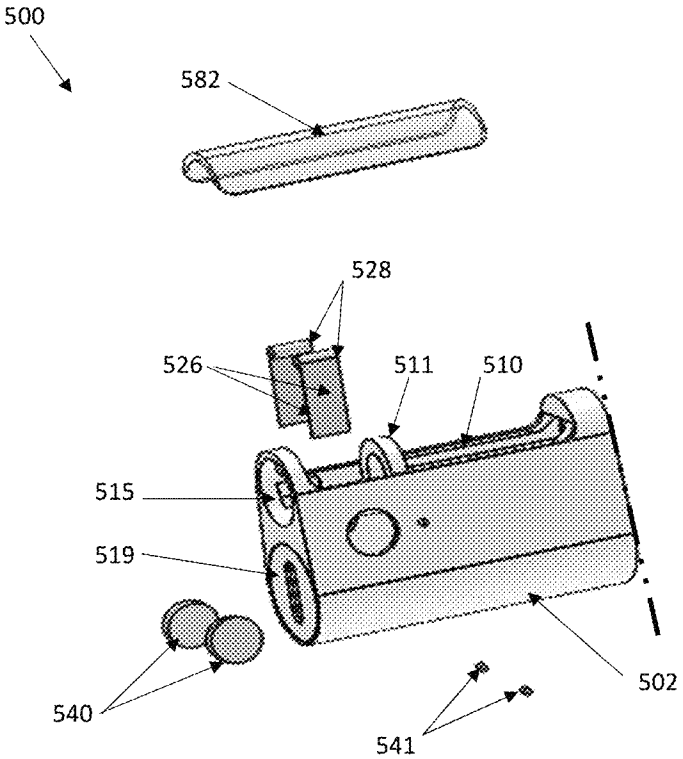
Figure 23:
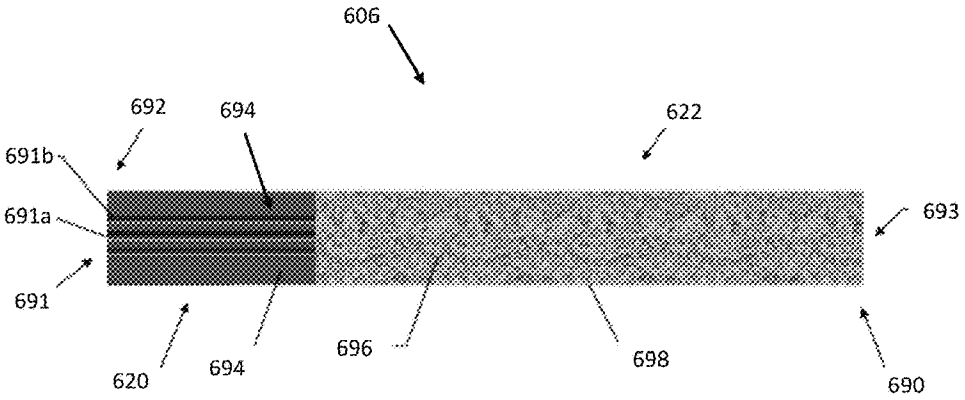
Figure 22:
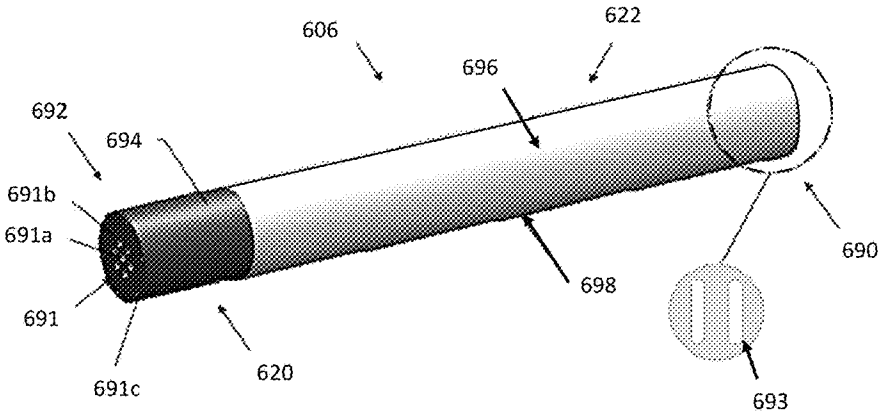

Having thus described the disclosure in the foregoing general terms, reference will now be made to the accompanying drawings, which are not necessarily drawn to scale, and wherein:

FIGS. 1A and 1B illustrate a perspective view and a cross-sectional side view, respectively, of an aerosol delivery device comprising a pair of static ignitor contacts, according to one implementation of the present disclosure;

FIG. 2 illustrates an exploded perspective view of the aerosol delivery device of FIG. 1A, according to one implementation of the present disclosure;

FIG. 3 illustrates an enlarged end view of a portion of a cartridge end of the aerosol delivery device of FIG. 1A, according to one implementation of the present disclosure;

FIG. 4 illustrates an enlarged, partial cross-sectional view of a portion of a cartridge end of the aerosol delivery device of FIG. 1A, according to one implementation of the present disclosure;

FIGS. 5A-5C illustrate a series of perspective views of the aerosol delivery device of FIG. 1A in various states of operation, according to one implementation of the present disclosure;

FIGS. 6A and 6B illustrate a perspective view and a cross-sectional side view, respectively, of another aerosol delivery device comprising a pair of static ignitor contacts, according to one implementation of the present disclosure;

FIG. 7 illustrates an exploded perspective view of the aerosol delivery device of FIG. 6A, according to one implementation of the present disclosure;

FIG. 8 illustrates an enlarged end view of a portion of a cartridge end of the aerosol delivery device of FIG. 6A, according to one implementation of the present disclosure;

FIG. 9 illustrates an enlarged, partial cross-sectional view of a portion of a cartridge end of the aerosol delivery device of FIG. 6A, according to one implementation of the present disclosure;

FIGS. 10A-10C illustrate a series of perspective views of the aerosol delivery device of FIG. 6A in various states of operation, according to one implementation of the present disclosure;

FIGS. 11A and 11B illustrate a perspective view and a cross-sectional side view, respectively, of yet another aerosol delivery device comprising a pair of static ignitor contacts, according to one implementation of the present disclosure;

FIG. 12A illustrates an exploded perspective view of the aerosol delivery device of FIG. 11A, according to one implementation of the present disclosure;

FIG. 12B illustrates an enlarged view of a portion of the device of FIG. 12A, according to one implementation of the present disclosure;

FIG. 13A illustrates an enlarged, partial cross sectional view of a portion of a cartridge end of the aerosol delivery device of FIG. 11A incorporating an alternative pair of static ignitor contacts, according to one implementation of the present disclosure;

FIG. 13B illustrates an enlarged perspective view of the alternative pair of static ignitor contacts of FIG. 13A, according to one implementation of the present disclosure;

FIGS. 14A and 14B illustrate a pair of perspective views of the aerosol delivery device of FIG. 11A in various states of operation, according to one implementation of the present disclosure;

FIGS. 15A and 15B illustrate a perspective view and a cross-sectional perspective view, respectively, of yet another aerosol delivery device comprising a pair of static ignitor contacts, according to one implementation of the present disclosure;

FIG. 16 illustrates an exploded perspective view of the aerosol delivery device of FIG. 15A, according to one implementation of the present disclosure;

FIG. 17A illustrates a perspective view of the aerosol delivery device of FIG. 15A in an open configuration with the static ignitor contacts exposed, according to one implementation of the present disclosure;

FIG. 17B illustrates an enlarged, partial cross-sectional view of a portion of the device of FIG. 17A, according to one implementation of the present disclosure;

FIG. 18 illustrates an enlarged top view of a portion of a cartridge end of the aerosol delivery device of FIG. 17A, according to one implementation of the present disclosure;

FIGS. 19A-19C illustrate a series of cross-sectional side views of the aerosol delivery device of FIG. 15A in various states of operation, according to one implementation of the present disclosure;

FIGS. 20A and 20B illustrate a perspective view and a cross-sectional perspective view, respectively, of an alternative aerosol delivery device, according to one implementation of the present disclosure;

FIG. 21 illustrates a partial exploded view of a portion of the aerosol delivery device of FIG. 20A, according to one implementation of the present disclosure;

FIG. 22 illustrates a perspective view of a removable cartridge, according to one implementation of the present disclosure; and FIG. 23 illustrates a longitudinal cross-section view of a removable cartridge, according to one implementation of the present disclosure.

DETAILED DESCRIPTION

Some implementations of the present disclosure will now be described more fully hereinafter with reference to the accompanying figures, in which some, but not all implementations of the disclosure are shown. Indeed, various implementations of the disclosure may be embodied in many different forms and should not be construed as limited to the implementations set forth herein; rather, these example implementations are provided so that this disclosure will be thorough and complete, and will fully convey the scope of the disclosure to those skilled in the art. Like reference numerals refer to like elements throughout.

Unless specified otherwise or clear from context, references to first, second or the like should not be construed to imply a particular order. A feature described as being above another feature (unless specified otherwise or clear from context) may instead be below, and vice versa; and similarly, features described as being to the left of another feature else may instead be to the right, and vice versa. Also, while reference may be made herein to quantitative measures, values, geometric relationships or the like, unless otherwise stated, any one or more if not all of these may be absolute or approximate to account for acceptable variations that may occur, such as those due to engineering tolerances or the like.

As used herein, unless specified otherwise or clear from context, the "or" of a set of operands is the "inclusive or" and thereby true if and only if one or more of the operands is true, as opposed to the "exclusive or" which is false when all of the operands are true. Thus, for example, "[A] or [B]" is true if [A] is true, or if [B] is true, or if both [A] and [B] are true. Further, the articles "a" and "an" mean "one or more," unless specified otherwise or clear from context to be directed to a singular form. Furthermore, it should be understood that unless otherwise specified, the terms "data," "content," "digital content," "information," and similar terms may be at times used interchangeably. Additionally, where multiples of the same components are described, the multiples may be referred to individually (e.g., ##a, ##b, ##c, etc.) or collectively (##).

The present disclosure provides descriptions of articles (and the assembly and/or manufacture thereof) in which a material is heated (preferably without combusting the material to any significant degree) to form an aerosol and/or an inhalable substance; such articles most preferably being sufficiently compact to be considered "hand-held" devices. In some aspects, the articles are characterized as smoking articles. As used herein, the term "smoking article" is intended to mean an article and/or device that provides many of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe, without any substantial degree of combustion of any component of that article and/or device. As used herein, the term "smoking article" does not necessarily mean that, in operation, the article or device produces smoke in the sense of an aerosol resulting from by-products of combustion or pyrolysis of tobacco, but rather, that the article or device yields vapors (including vapors within aerosols that are considered to be visible aerosols that might be considered to be described as smoke-like) resulting from volatilization or vaporization of certain components, elements, and/or the like of the article and/or device. In some aspects, articles or devices characterized as smoking articles incorporate tobacco and/or components derived from tobacco.

As noted, aerosol delivery devices may provide many of the sensations (e.g., inhalation and exhalation rituals, types of tastes or flavors, organoleptic effects, physical feel, use rituals, visual cues such as those provided by visible aerosol, and the like) of smoking a cigarette, cigar or pipe that is employed by lighting and burning tobacco (and hence inhaling tobacco smoke), without any substantial degree of combustion of any component thereof. For example, the user of an aerosol delivery device in accordance with some example implementations of the present disclosure can hold and use that device much like a smoker employs a traditional type of smoking article, draw on one end of that piece for inhalation of aerosol produced by that piece, take or draw puffs at selected intervals of time, and the like.

Articles or devices of the present disclosure are also characterized as being vapor-producing articles, aerosol delivery articles, or medicament delivery articles. Thus, such articles or devices are adaptable so as to provide one or more substances in an inhalable form or state. For example, inhalable substances are substantially in the form of a vapor (e.g., a substance that is in the gas phase at a temperature lower than its critical point). Alternatively, inhalable substances are in the form of an aerosol (e.g., a suspension of fine solid particles or liquid droplets in a gas). For purposes of simplicity, the term "aerosol" as used herein is meant to include vapors, gases, and aerosols of a form or type suitable for human inhalation, whether or not visible, and whether or not of a form that might be considered to be smoke-like. In some implementations, the terms "vapor" and "aerosol" may be interchangeable. Thus, for simplicity, the terms "vapor" and "aerosol" as used to describe the disclosure are understood to be interchangeable unless stated otherwise.

Examples of suitable vapor-producing articles, aerosol delivery articles, or medicament delivery articles include vapor products, heat-not-burn products, hybrid products and the like. Vapor products are commonly known as "electronic cigarettes," "e-cigarettes" or electronic nicotine delivery systems (ENDS), although the aerosol-generating material need not include nicotine. Many vapor products are designed to heat a liquid material to generate an aerosol. Other vapor products are designed to break up an aerosol-generating material into an aerosol without heating, or with only secondary heating. Heat-not-burn products include tobacco heating products and carbon-tipped tobacco heating products, and many are designed to heat a solid material to generate an aerosol without combusting the material.

Hybrid products use a combination of aerosol-generating materials, one or a plurality of which may be heated. Each of the aerosol-generating materials may be, for example, in the form of a solid, semi-solid, liquid, or gel. Some hybrid products are similar to vapor products except that the aerosol generated from a liquid or gel aerosol-generating material passes through a second material (such as tobacco) to pick up additional constituents before reaching the user. In some example implementations, the hybrid system includes a liquid or gel aerosol-generating material, and a solid aerosol-generating material. The solid aerosol-generating material may include, for example, tobacco or a non-tobacco product.

In use, smoking articles of the present disclosure are subjected to many of the physical actions of an individual in using a traditional type of smoking article (e.g., a cigarette, cigar, or pipe that is employed by lighting with a flame and used by inhaling tobacco that is subsequently burned and/or combusted). For example, the user of a smoking article of the present disclosure holds that article much like a traditional type of smoking article, draws on one end of that article for inhalation of an aerosol produced by that article, and takes puffs at selected intervals of time.

While the systems are generally described herein in terms of implementations associated with smoking articles such as so-called "tobacco heating products," it should be understood that the mechanisms, components, features, and methods may be embodied in many different forms and associated with a variety of articles. For example, the description provided herein may be employed in conjunction with implementations of traditional smoking articles (e.g., cigarettes, cigars, pipes, etc.), heat-not-burn cigarettes, and related packaging for any of the products disclosed herein. Accordingly, it should be understood that the description of the mechanisms, components, features, and methods disclosed herein are discussed in terms of implementations relating to aerosol delivery devices by way of example only, and may be embodied and used in various other products and methods.

Aerosol delivery devices of the present disclosure generally include a number of components provided within an outer body or shell, which may be referred to as a housing or a holder. The overall design of the outer body or shell can vary, and the format or configuration of the outer body that can define the overall size and shape of the aerosol delivery device can vary. In some example implementations, an elongated body resembling the shape of a cigarette or cigar can be formed from a single, unitary housing or the elongated housing can be formed of two or more separable bodies. For example, an aerosol delivery device can comprise an elongated shell or body that can be substantially tubular in shape and, as such, resemble the shape of a conventional cigarette or cigar. In another example, an aerosol delivery device may be substantially rectangular or have a substantially rectangular cuboid shape. In one example, all of the components of the aerosol delivery device are contained within one housing. Alternatively, an aerosol delivery device can comprise two or more housings that are joined and are separable. For example, an aerosol delivery device can possess one portion comprising a housing containing one or more reusable components (e.g., an accumulator such as a rechargeable battery and/or rechargeable super-capacitor, and various electronics for controlling the operation of that article), and removably coupleable thereto, another second portion (e.g., a mouthpiece) and/or a disposable component (e.g., a disposable flavor-containing cartridge containing aerosol precursor material, flavorant, etc.). More specific formats, configurations and arrangements of components within the single housing type of unit or within a multi-piece separable housing type of unit will be evident in light of the further disclosure provided herein. Additionally, various aerosol delivery device designs and component arrangements can be appreciated upon consideration of the commercially available electronic aerosol delivery devices.

As will be discussed in more detail below, holders of aerosol delivery devices of the present disclosure may comprise some combination of a power source (e.g., an electrical power source), at least one control component (e.g., means for translating, controlling, regulating and ceasing power, such as by controlling electrical current flow from the power source to other components of the article—e.g., a microprocessor, individually or as part of a microcontroller, a printed circuit board (PCB) that includes a microprocessor and/or microcontroller, etc.), a lighter portion configured to heat a heat source and/or substrate material of a cartridge, and a receiving chamber. Such holders may be configured to accept one or more substrate cartridges that include a substrate material capable of yielding an aerosol upon application of sufficient heat. In some implementations, the holder may include a mouthpiece portion configured to allow drawing upon the holder for aerosol inhalation (e.g., a defined airflow path through the holder such that aerosol generated can be withdrawn therefrom upon draw).

In various aspects, the heat source of a cartridge may be capable of generating heat to aerosolize a substrate material of the cartridge that comprises, for example, an extruded structure and/or substrate, a substrate material associated with an aerosol precursor composition, tobacco and/or a tobacco related material, such as a material that is found naturally in tobacco that is isolated directly from the tobacco or synthetically prepared, in a solid or liquid form (e.g., beads, sheets, shreds, a wrap), or the like. As will be described in more detail below, in some implementations, an extruded structure may comprise tobacco products or a composite of tobacco with other materials such as, for example, ceramic powder. In other implementations, a tobacco extract/slurry may be loaded into porous ceramic beads. Other implementations may use non-tobacco products. In some implementations aerosol precursor composition-loaded porous beads/powders (ceramics) may be used. In other implementations, rods/cylinders made of extruded slurry of ceramic powder and aerosol precursor composition may be used.

In some implementations, the substrate material may comprise a liquid including an aerosol precursor composition and/or a gel including an aerosol precursor composition. Some examples of liquid compositions can be found in U.S. Pat. Pub. No. US 2020/0113239 to Aller et al., which is incorporated herein by reference in its entirety. As noted above, in various implementations, one or more of the substrate materials may have an aerosol precursor composition associated therewith. For example, in some implementations the aerosol precursor composition may comprise one or more different components, such as polyhydric alcohol (e.g., glycerin, propylene glycol, or a mixture thereof). Representative types of further aerosol precursor compositions are set forth in U.S. Pat. No. 4,793,365 to Sensabaugh, Jr. et al.; U.S. Pat. No. 5,101,839 to Jakob et al.; PCT WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference. In some aspects, a substrate material may produce a visible aerosol upon the application of sufficient heat thereto (and cooling with air, if necessary), and the substrate material may produce an aerosol that is "smoke-like." In other aspects, the substrate material may produce an aerosol that is substantially non-visible but is recognized as present by other characteristics, such as flavor or texture. Thus, the nature of the produced aerosol may be variable depending upon the specific components of the aerosol delivery component. The substrate material may be chemically simple relative to the chemical nature of the smoke produced by burning tobacco.

In some implementations, the aerosol precursor composition may incorporate nicotine, which may be present in various concentrations. The source of nicotine may vary, and the nicotine incorporated in the aerosol precursor composition may derive from a single source or a combination of two or more sources. For example, in some implementations the aerosol precursor composition may include nicotine derived from tobacco. In other implementations, the aerosol precursor composition may include nicotine derived from other organic plant sources, such as, for example, non-tobacco plant sources including plants in the Solanaceae family. In other implementations, the aerosol precursor composition may include synthetic nicotine. In some implementations, nicotine incorporated in the aerosol precursor composition may be derived from non-tobacco plant sources, such as other members of the Solanaceae family. The aerosol precursor composition may additionally, or alternatively, include other active ingredients including, but not limited to, botanical ingredients (e.g., lavender, peppermint, chamomile, basil, rosemary, thyme, eucalyptus, ginger, cannabis, ginseng, maca, and tisanes), stimulants (e.g., caffeine and guarana), amino acids (e.g., taurine, theanine, phenylalanine, tyrosine, and tryptophan) and/or pharmaceutical, nutraceutical, and medicinal ingredients (e.g., vitamins, such as B6, B12, and C and cannabinoids, such as tetrahydrocannabinol (THC) and cannabidiol (CBD)). It should be noted that the aerosol precursor composition may comprise any constituents, derivatives, or combinations of any of the above.

As noted herein, the aerosol precursor composition may comprise or be derived from one or more botanicals or constituents, derivatives, or extracts thereof. As used herein, the term "botanical" includes any material derived from plants including, but not limited to, extracts, leaves, bark, fibers, stems, roots, seeds, flowers, fruits, pollen, husk, shells or the like. Alternatively, the material may comprise an active compound naturally existing in a botanical, obtained synthetically. The material may be in the form of liquid, gas, solid, powder, dust, crushed particles, granules, pellets, shreds, strips, sheets, or the like. Example botanicals are tobacco, eucalyptus, star anise, hemp, cocoa, cannabis, fennel, lemongrass, peppermint, spearmint, rooibos, chamomile, flax, ginger, *Ginkgo biloba*, hazel, hibiscus, laurel, licorice (liquorice), matcha, mate, orange skin, papaya, rose, sage, tea such as green tea or black tea, thyme, clove, cinnamon, coffee, aniseed (anise), basil, bay leaves, cardamom, coriander, cumin, nutmeg, oregano, paprika, rosemary, saffron, lavender, lemon peel, mint, juniper, elderflower, vanilla, wintergreen, beefsteak plant, curcuma, turmeric, sandalwood, cilantro, bergamot, orange blossom, myrtle, cassis, valerian, pimento, mace, damien, marjoram, olive, lemon balm, lemon basil, chive, carvi, verbena, tarragon, geranium, mulberry, ginseng, theanine, theacrine, maca, ashwagandha, damiana, guarana, chlorophyll, baobab or any combination thereof. The mint may be chosen from the following mint varieties: *Mentha arventis, Mentha* c.v., *Mentha niliaca, Mentha piperita, Mentha piperita citrata* c.v., *Mentha piperita* c.v, *Mentha spicata crispa, Mentha cardifolia, Mentha longifolia, Mentha suaveolens variegata, Mentha pulegium, Mentha spicata* c.v. and *Mentha suaveolens.*

A wide variety of types of flavoring agents, or materials that alter the sensory or organoleptic character or nature of the mainstream aerosol of the smoking article may be suitable to be employed. In some implementations, such flavoring agents may be provided from sources other than tobacco and may be natural or artificial in nature. For example, some flavoring agents may be applied to, or incorporated within, the substrate material and/or those regions of the smoking article where an aerosol is generated. In some implementations, such agents may be supplied directly to a heating cavity or region proximate to the heat source or are provided with the substrate material. Example flavoring agents may include, for example, vanillin, ethyl vanillin, cream, tea, coffee, fruit (e.g., apple, cherry, strawberry, peach and citrus flavors, including lime and lemon), maple, menthol, mint, peppermint, spearmint, wintergreen, nutmeg, clove, lavender, cardamom, ginger, honey, anise, sage, cinnamon, sandalwood, jasmine, cascarilla, cocoa, licorice, and flavorings and flavor packages of the type and character traditionally used for the flavoring of cigarette, cigar, and pipe tobaccos. Syrups, such as high fructose corn syrup, may also be suitable to be employed.

As used herein, the terms "flavor," "flavorant," "flavoring agents," etc. refer to materials which, where local regulations permit, may be used to create a desired taste, aroma, or other somatosensorial sensation in a product for adult consumers. They may include naturally occurring flavor materials, botanicals, extracts of botanicals, synthetically obtained materials, or combinations thereof (e.g., tobacco, cannabis, licorice (liquorice), hydrangea, eugenol, Japanese white bark magnolia leaf, chamomile, fenugreek, clove, maple, matcha, menthol, Japanese mint, aniseed (anise), cinnamon, turmeric, Indian spices, Asian spices, herb, wintergreen, cherry, berry, red berry, cranberry, peach, apple, orange, mango, clementine, lemon, lime, tropical fruit, papaya, rhubarb, grape, durian, dragon fruit, cucumber, blueberry, mulberry, citrus fruits, Drambuie, bourbon, scotch, whiskey, gin, tequila, rum, spearmint, peppermint, lavender, aloe vera, cardamom, celery, cascarilla, nutmeg, sandalwood, bergamot, geranium, khat, naswar, betel, shisha, pine, honey essence, rose oil, vanilla, lemon oil, orange oil, orange blossom, cherry blossom, cassia, caraway, cognac, jasmine, ylang-ylang, sage, fennel, wasabi, piment, ginger, coriander, coffee, hemp, a mint oil from any species of the genus *Mentha*, eucalyptus, star anise, cocoa, lemongrass, rooibos, flax, *Ginkgo biloba*, hazel, hibiscus, laurel, mate, orange skin, rose, tea such as green tea or black tea, thyme, juniper, elderflower, basil, bay leaves, cumin, oregano, paprika, rosemary, saffron, lemon peel, mint, beefsteak plant, curcuma, cilantro, myrtle, cassis, valerian, pimento, mace, damien, marjoram, olive, lemon balm, lemon basil, chive, carvi, verbena, tarragon, limonene, thymol, camphene), flavor enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, liquid such as an oil, solid such as a powder, or gas.

In some implementations, the flavor comprises menthol, spearmint and/or peppermint. In some embodiments, the flavor comprises flavor components of cucumber, blueberry, citrus fruits and/or redberry. In some embodiments, the flavor comprises eugenol. In some embodiments, the flavor comprises flavor components extracted from tobacco. In some embodiments, the flavor comprises flavor components extracted from cannabis.

In some implementations, the flavor may comprise a sensate, which is intended to achieve a somatosensorial sensation which are usually chemically induced and perceived by the stimulation of the fifth cranial nerve (trigeminal nerve), in addition to or in place of aroma or taste nerves, and these may include agents providing heating, cooling, tingling, numbing effect. A suitable heat effect agent may be, but is not limited to, vanillyl ethyl ether and a suitable cooling agent may be, but not limited to eucolyptol, WS-3.

Flavoring agents may also include acidic or basic characteristics (e.g., organic acids, such as levulinic acid, succinic acid, pyruvic acid, and benzoic acid). In some implementations, flavoring agents may be combinable with the elements of the substrate material if desired. Example plant-derived compositions that may be suitable are disclosed in U.S. Pat. No. 9,107,453 and U.S. Pat. App. Pub. No.

2012/0152265 both to Dube et al., the disclosures of which are incorporated herein by reference in their entireties. Any of the materials, such as flavorings, casings, and the like that may be useful in combination with a tobacco material to affect sensory properties thereof, including organoleptic properties, such as described herein, may be combined with the substrate material. Organic acids particularly may be able to be incorporated into the substrate material to affect the flavor, sensation, or organoleptic properties of medicaments, such as nicotine, that may be able to be combined with the substrate material. For example, organic acids, such as levulinic acid, lactic acid, pyruvic acid, and benzoic acid may be included in the substrate material with nicotine in amounts up to being equimolar (based on total organic acid content) with the nicotine. Any combination of organic acids may be suitable. For example, in some implementations, the substrate material may include approximately 0.1 to about 0.5 moles of levulinic acid per one mole of nicotine, approximately 0.1 to about 0.5 moles of pyruvic acid per one mole of nicotine, approximately 0.1 to about 0.5 moles of lactic acid per one mole of nicotine, or combinations thereof, up to a concentration wherein the total amount of organic acid present is equimolar to the total amount of nicotine present in the substrate material. Various additional examples of organic acids employed to produce a substrate material are described in U.S. Pat. App. Pub. No. 2015/0344456 to Dull et al., which is incorporated herein by reference in its entirety.

The selection of such further components may be variable based upon factors such as the sensory characteristics that are desired for the smoking article, and the present disclosure is intended to encompass any such further components that are readily apparent to those skilled in the art of tobacco and tobacco-related or tobacco-derived products. See, Gutcho, Tobacco Flavoring Substances and Methods, Noyes Data Corp. (1972) and Leffingwell et al., Tobacco Flavoring for Smoking Products (1972), the disclosures of which are incorporated herein by reference in their entireties.

In other implementations, the substrate material may include other materials having a variety of inherent characteristics or properties. For example, the substrate material may include a plasticized material or regenerated cellulose in the form of rayon. As another example, viscose (commercially available as VISIL®), which is a regenerated cellulose product incorporating silica, may be suitable. Some carbon fibers may include at least 95 percent carbon or more. Similarly, natural cellulose fibers such as cotton may be suitable, and may be infused or otherwise treated with silica, carbon, or metallic particles to enhance flame-retardant properties and minimize off-gassing, particularly of any undesirable off-gassing components that would have a negative impact on flavor (and especially minimizing the likelihood of any toxic off-gassing products). Cotton may be treatable with, for example, boric acid or various organophosphate compounds to provide desirable flame-retardant properties by dipping, spraying or other techniques known in the art. These fibers may also be treatable (coated, infused, or both by, e.g., dipping, spraying, or vapor-deposition) with organic or metallic nanoparticles to confer the desired property of flame-retardancy without undesirable off-gassing or melting-type behavior.

More specific formats, configurations and arrangements of components within the non-combustible aerosol provision systems of the present disclosure will be evident in light of the further disclosure provided hereinafter. Additionally, the selection and arrangement of various non-combustible aerosol provision system components can be appreciated upon consideration of the commercially available electronic non-combustible aerosol provision systems, such as those representative products referenced in the background art section of the present disclosure.

According to certain aspects of the present disclosure, it may be advantageous to provide an aerosol delivery device that is easy to use and that provides reusable and/or replaceable components. FIGS. 1A, 1B, and 2 illustrate one example implementation of such a device 100. In particular, FIGS. 1A and 1B illustrate a perspective view and a cross-sectional side view, respectively, of an aerosol delivery device 100 that includes a static ignitor contact arrangement 128. Generally, "static" contacts are intended to include contacts that are fixed relative to the device and/or an ignitable heat source and do not require being actuated (e.g., by a user) in order to contact/ignite the ignitable heat source. Incidental movement (e.g., flexing to grip/release the cartridge) does not render the ignitor contacts as non-static. Specifically, the aerosol delivery device 100 comprises a holder 102 having a main body defining a proximal end 102*a* and a distal end 102*b*, where the holder 102 further defines a receiving chamber 110 configured to receive a removable cartridge 106 and an aerosol passageway 150 that extends through at least a portion of the main body. The removable cartridge 106 comprises an ignitable heat source 120 and a substrate portion that includes a substrate material having an aerosol precursor composition configured to form an aerosol upon application of heat thereto.

The holder 102 further comprises an access door assembly 189 pivotably coupled to the main body via a pivot assembly 184 (e.g., pivot pin 184*a*, receptacle 184*b* as shown in FIG. 2), although in some implementations, the door assembly 189 may be slidingly or hingedly coupled to the holder 102. As depicted in FIGS. 1A, 1B, and 2, the door assembly 189 includes a door 188 configured to fit substantially flush with an outer surface of the holder 102 in a closed configuration and sized and shaped to receive a chassis or inner housing 124 defining the receiving chamber 110 for receiving the cartridge 106 therein. The chassis 124 may comprise a plurality of material layers that provide for temperature control of the device, for example, thermal insulation to prevent heat from the cartridge being transferred to the holder and a user contacting a "hot" device. The assembly 189 further comprises a pair of static ignitor contacts 128 disposed proximate the distal end 102*b* of the holder, a door seal mechanism 160 configured to sealingly engage the receiving chamber 110 with the first aerosol passageway, and a biasing mechanism 142 configured to urge a loaded cartridge into contact with the ignitor contacts 128 when in the closed configuration. The door assembly 189 is moved between its open configuration and closed configuration via a spring-loaded slider button as discussed in greater detail with respect to FIGS. 5A-5C. The static contact arrangement 128 is described in greater detail with respect to FIGS. 3 and 4.

FIG. 3 provides an end view of the distal end 102*b* of the device 100 depicting the orientation of the static ignitor contacts 128 relative to the ignitable heat source 120 of the removable cartridge and the door assembly 189 in the closed configuration. As shown, a pair of static ignitor contacts is disposed on or in the access door assembly 189 and oriented to contact the ignitable heat source 120 when the removable cartridge 106 is secured within the receiving chamber and the access door assembly 189 is in the closed configuration. Specifically, the contacts 128 comprise a rigid or semi-rigid material disposed in the distal end of the chassis 124.

Generally, each ignitor contact may be formed from a wire or flat strip of metal (e.g., copper, silver, gold, or other conductive material) bent or otherwise shaped to form a desired shape for a particular application. For example, as shown in in FIG. 2, each ignitor contact 128 has a generally U-shape. In some implementations, the bend(s) in the contacts may provide resiliency to the contacts so as to enable a minimal amount of flexing to accommodate a particular cartridge 106. The contacts are configured as bent wires oriented in the chassis 124 so as to span an opening 115 in the distal end of the chassis 124 so as to contact the distal end of the ignitable heat source 120 in two places. The contacts 128 may be secured to the chassis 124 via, for example, bonding or a snap fit. In the closed configuration, at least a portion of each ignitor contact 128 engages a corresponding electrical contacts 129 so as to complete the electrical circuit as described below. In some implementations, the electrical contacts 129 are pogo pins disposed on a printed circuit board. Further depicted in FIG. 3 is a charging port 119 described in greater detail below.

Referring to FIG. 4, in the closed configuration, the cartridge 106 is secured within the holder 102 and the receiving chamber 110 is in fluid communication with the first aerosol passageway 150 (see also FIG. 1). The seal assembly 160 prevents aerosol loss and/or air ingress between the door assembly 189 and holder 102 when in the closed configuration. Disposed within the holder is a biasing mechanism 142, which may be a bent spring element, that is configured and positioned to contact the proximal end of the cartridge 106, thereby urging the ignitable heat source portion 120 of the cartridge into contact with the ignitor contacts 128 to provide a good connection therebetween.

Referring back to FIG. 2, the device 100 further comprises a power source 112 and a PCB 118 disposed within the holder 102. The power source 112 is in electrical communication with the PCB 118 and the static ignitor contacts 128 via wiring or other means for electrically coupling a variety of components. The PCB 118 includes the electrical contacts 129 that contact the ignitor contacts 128 when the door assembly 189 is in the closed configuration. In some implementations, the electrical contacts extend through a wall of the holder 102 so as to be accessible to the ignitor contacts 128, and may include a gasket or other sealing mechanism 139 to seal the contacts 129 with the holder 102. The PCB 118 may further comprise a charging port 119 (e.g., a micro-USB connector) that is oriented on the PCB so as to be disposed at one end of the holder 102 (see FIG. 3).

In the depicted implementation, an ignitor push button (or switch generally) 140 is disposed in a side wall of the holder 102 and configured, so that when pressed by a user, the button 140 activates the ignitor contacts 128 thereby igniting the heat source 120 of the cartridge 106. Specifically, once the push button 140 is actuated, the electrical circuit is completed and electricity is delivered to the ignitor contacts 128. In some implementations, the ignitor contacts 128 will only remain activated while the ignitor push button 140 is depressed. As such, in some implementations, the ignitor contacts 128 will be deactivated when the ignitor push button 140 is released. In some implementations, the ignitor push button 140 may be configured to activate the ignitor contacts 128 for a set time after release. In one implementation, the push button 140 extends through an opening 163 in the holder 102. In some implementations, the button 140 is spring loaded and may return to an off position after igniting the heat source. The device 100 may further include an LED ring 141 proximate the push button 140 that may illuminate during ignition and/or change colors to indicate a state of the device 100.

The device 100 further includes a mouthpiece 104 as shown in FIGS. 1A, 1B, and 2. The mouthpiece 104 has a first end configured to engage with a user's mouth and a longitudinally opposed second end with a second aerosol passageway 154 extending longitudinally therebetween. The mouthpiece 104 may be coupled to the holder 102 via an amount of frictional resistance sufficient to secure the mouthpiece 104 to the holder 102, but minimal enough so that a user may remove the mouthpiece 104 without significant effort. For example, the mouthpiece may be removed from the holder by, for example, application of a pulling or twisting action to the mouthpiece 104 or actuating a release. The mouthpiece 104 can be removed for access to an optional flow restrictor 165 described below, which can then be removed for cleaning or replacement to customize the user's experience. The mouthpiece 104 may also be cleaned and/or replaced after removal. Alternatively, the mouthpiece 104 may be integrally formed with the holder 102.

In the depicted implementation, the mouthpiece 104 is coupled to the proximal end 102*a* of the holder 102 via a body portion 155 disposed at the distal end of the mouthpiece 104. The body portion 155 is configured to removably and/or sealingly engage an opening in the proximal end of the holder 102. The body portion 155 is sized and shaped to engage an opening in the proximal end of the holder 102, such that the body portion 155 is disposed within the proximal end of the holder 102, with or without a sealing mechanism, so as to be substantially flush with the proximal end 102*a* of the holder. In some implementations, the body portion 155 may be coupled to the holder 102 via at least one fastener (e.g., a screw) and/or physically engage an inner wall of the holder 102. The mouthpiece 104 further comprises a nozzle or extension 105 that makes up the first end of the mouthpiece and is configured to be engaged by the user's mouth. The nozzle 105 partially defines the second aerosol passageway 154 and terminates at an opening 158 configured to pass the generated aerosol to the user.

At the opposing side of the body portion 155, a hollow stem 107 extends into the holder when assembled. Specifically, in some implementations, the main body of the holder 102 includes a tubular structure 121 disposed therein and extending along a length of the holder 102. The tubular structure 121 at least partially defines the first aerosol passageway 150 and extends towards the proximal end of the holder 102 and is configured to engage at least a portion of the mouthpiece 104 to provide fluid communication between the first and second aerosol passageways 150, 154 and deliver the aerosol to a user via the opening 158. In the depicted implementation, the stem 107 engages with the tubular structure 121 with the optional flow restrictor essentially "sandwiched" therebetween. In some implementations, the flow restrictor 165 may be inserted into the tubular structure 121 of the holder so that a lip thereof abuts the proximal end of the tubular structure 121, and then the mouthpiece 104 is secured to the proximal end of the holder 102 such that the stem 107 passes over the flow restrictor 165 and the proximal end of the tubular structure 121, fluidly coupling the aerosol passageways. Alternatively, or additionally, the mouthpiece 104 and/or optional flow restrictor 165 may be removably secured in or to the holder 102 via at least one of complementary-threaded surfaces for a screw-type engagement, a press-fit engagement, a snap-fit engagement, a frictional engagement, or a magnetic engagement.

FIGS. 5A-5C illustrate the general operation (e.g., loading and ejecting of the cartridge (i.e., consumable)) of the device 100. Specifically, FIG. 5A depicts the door assembly 189 in the closed configuration with the door assembly 189 enclosing the receiving chamber 110 within the holder 102. In order to move the door assembly into the open configuration, a spring-loaded slider button 108 is slid forward or distally so as to release (e.g., unlatch) the door assembly 189 from the holder 102. The door assembly 189 is biased into the open configuration (e.g., via a spring mechanism disposed within the holder) as shown in FIG. 5B, thereby exposing the chassis 124 and the receiving chamber 110 disposed therein.

As further shown in FIG. 5B, the cartridge 106 is inserted into the receiving chamber 110 with the ignitable heat source 120 end inserted first. Once the cartridge 106 is loaded, the door assembly 189 is pushed closed (the biasing force is small enough that a user may close the door assembly with a single finger) and the slide button 108 reconnects to the holder 102 to secure the door assembly 189 in the closed configuration as shown in FIG. 5A.

In the closed configuration, the cartridge 106 is secured within the holder so as to be in fluid communication with the first aerosol passageway 150 (see FIG. 1). The ignitable heat source 120 is in contact with the ignitor contacts 128 via the biasing mechanism 142 and may be ignited so that the cartridge may be consumed (i.e., aerosol generated and delivered to the user via the aerosol passageways). In a particular implementation, air may be drawn into the device 100 via opening 115 (see also FIG. 3) to provide oxygen to the ignited heat source. In some implementations, the air/oxygen may travel through the heat source and/or mix with an aerosol generated by the removable cartridge and deliverable to a user via the mouthpiece 104.

After being consumed, the cartridge 106 may be ejected from the device 100 as shown in FIG. 5C. Specifically, the slide button 108 is slid forward or distally so as to release the door assembly 189 and expose the cartridge 106. Once in the open configuration, the device 100 may be turned upside-down, which allows the cartridge to fall out of the receiving chamber 110. After ejection, a user may insert a new cartridge or simply close the door assembly 189 and store the device 100 for later use. In some implementations, the device 100 may include an additional latching mechanism (not shown) configured to further secure the access door assembly 189 in the closed configuration. In some implementations, the latching mechanism may include a magnetic engagement, a threaded interface, a snap-fit, a detent, and/or be spring-loaded into the closed configuration.

In some alternative implementations, the aerosol is generated by an electric heater configured to perform electric heating in which electrical energy from the power source is delivered to the heater when the actuator assembly is moved into the lighting/use position. Subjecting the aerosol-generating material (substrate 122) to heat releases one or more volatiles from the aerosol-generating material to form an aerosol. Examples of suitable forms of electric heating include resistance (Joule) heating, induction heating, dielectric and microwave heating, radiant heating, arc heating and the like. More particular examples of suitable electric heaters include resistive heating elements such as wire coils, flat plates, prongs, conductive meshes, radiant heaters, conductive inks, micro heaters or the like.

In some examples, the cartridge 106 may include a susceptor (e.g., the susceptor may be part of the substrate 122). The susceptor is a material that is heatable by penetration with a varying magnetic field generated by a magnetic field generator that may be separate from or part of the aerosol generator. The susceptor may be an electrically-conductive material, so that penetration thereof with a varying magnetic field causes induction heating of the heating material. The heating material may be magnetic material, so that penetration thereof with a varying magnetic field causes magnetic hysteresis heating of the heating material. The susceptor in some examples may be both electrically-conductive and magnetic, so that the susceptor of these examples is heatable by both heating mechanisms.

FIGS. 6A, 6B, and 7 illustrate another example implementation of an aerosol delivery device 200. In particular, FIGS. 6A and 6B illustrate a perspective view and a cross-sectional side view, respectively, of an aerosol delivery device 200 that includes a static ignitor contact arrangement 228. Specifically, the aerosol delivery device 200 comprises a holder 202 having a main body defining a proximal end 202*a* and a distal end 202*b*, where the holder 202 further defines a receiving chamber 210 configured to receive a removable cartridge 206 and an aerosol passageway 250 that extends through at least a portion of the main body. The removable cartridge 206 comprises an ignitable heat source 220 and a substrate portion that includes a substrate material having an aerosol precursor composition configured to form an aerosol upon application of heat thereto.

The holder 202 further comprises an access door assembly 289 pivotably coupled to the main body via a pivot assembly 284, although in some implementations, the door assembly 289 may be slidingly or hingedly coupled to the holder 202. As depicted in FIG. 7, the door assembly 289 includes a door 288 configured to fit substantially flush with an outer surface of the holder 202 in a closed configuration and sized and shaped to receive a chassis or inner housing 224 defining the receiving chamber 210 for receiving the cartridge 206 therein. The chassis 224 may comprise a plurality of material layers that provide for temperature control of the device, for example, thermal insulation to prevent heat from the cartridge being transferred to the holder and a user contacting a "hot" device. The assembly 289 further comprises a pair of static ignitor contacts 228 disposed proximate the distal end 202*b* of the holder, a seal mechanism 260 configured to sealingly engage the receiving chamber 210 with the first aerosol passageway 250, and a biasing mechanism 242 configured to urge a loaded cartridge into contact with the ignitor contacts 228 when in the closed configuration. The door assembly 289 is moved between its closed configuration and open configuration via, for example, a user's thumb sliding the door assembly downwardly and pivoting it outwardly from the holder 202 for loading and ejecting the cartridge. Once the cartridge 206 is loaded, the door assembly 289 may be closed by pushing the door assembly 289 back towards the holder 202, as discussed in greater detail with respect to FIGS. 10A-10C. The static ignitor contact arrangement 228 is described in greater detail with respect to FIGS. 8 and 9.

FIG. 8 provides an end view of the distal end 202*b* of the device 200 depicting the orientation of the static ignitor contacts 228 relative to the ignitable heat source 220 of the removable cartridge and the door assembly 289 in the closed configuration. As shown, a pair of static ignitor contacts is disposed on or in the access door assembly 289 and oriented to contact the ignitable heat source 220 when the removable cartridge 206 is secured within the receiving chamber and the access door assembly 289 is in the closed configuration. Specifically, the contacts 228 comprise a rigid or semi-rigid material disposed in the distal end of the chassis 224 via, for example, a pair of grooves 224*a* formed in the chassis.

Generally, each ignitor contact may be formed from a wire or flat strip of metal (e.g., copper, silver, gold, or other conductive material) bent or otherwise shaped to form a desired shape for a particular application. For example, as shown in in FIG. 7, each ignitor contact 228 has a generally J-shape. In some implementations, the bend(s) in the contacts may provide resiliency to the contacts 228 so as to enable a minimal amount of flexing to accommodate a particular cartridge 206. The contacts are configured as bent wires oriented in the chassis 224 so as to span an opening 215' in the distal end of the chassis 224 so as to contact the distal end of the ignitable heat source 220 in two places. The contacts 228 may be secured to the chassis 224 via, for example, bonding or a snap fit.

Referring to FIG. 9, in the closed configuration, the cartridge 206 is secured within the holder 202 and the receiving chamber 210 is in fluid communication with the first aerosol passageway 250 in a similar manner as shown in FIG. 4 (see also FIG. 6B). Although not shown in FIG. 9, the door assembly 289 also engages the holder 202 with the seal assembly 260 so as to prevent aerosol loss and/or air ingress between the door assembly 289 and holder 202 when in the closed configuration, and the biasing mechanism 242 (e.g., a helical compression spring) is disposed within the holder and is configured and positioned to contact the proximal end of the cartridge 206, thereby urging the ignitable heat source portion 220 of the cartridge into contact with the ignitor contacts 228 to provide a good connection therebetween. In the closed configuration, at least a portion of each ignitor contact 228 engages a corresponding electrical contact 229 so as to complete the electrical circuit as described below. The electrical contacts 229 are pogo pins disposed on a PCB 218 and extend through a wall of the holder 202 so as to be accessible to the ignitor contacts 228, and may include a gasket or other sealing mechanism 239 to seal the contacts 229 with the holder 202. In the depicted implementation, moving the door 288 into the open configuration breaks the electric circuit (e.g., the ignitor contacts 228 no longer engage the electrical contacts 229), thereby preventing inadvertent electrification of the ignitor contacts. The PCB 218*a* includes a charging port 219 (e.g., a micro-USB connector) that is oriented on the PCB so as to be disposed at one end of the holder 202.

As further depicted in FIG. 9, the door 288 defines an opening 215 in the distal end thereof that allows for the ingress of air (e.g., via a user drawing on one end of the device for inhalation of an aerosol produced thereby). The air drawn into the distal end of the device 200 (arrow A) provides oxygen to the ignited heat source 220. The air/oxygen may travel through the heat source 220 and combine with the aerosol generated from the substrate 222, and then be delivered to a user via the mouthpiece. More specifically, when a user draws on the holder 202 (e.g., via the mouthpiece 204), ambient air may be drawn into the device 200 via the opening 215, travel through the cartridge 206 where the air mixes with the aerosol produced by the cartridge, and then travels through the first and second aerosol passageways 250, 254 for inhalation by the user. In some implementations, the door 288 engages the holder 202 via a gasket or other sealing mechanism so that there is no aerosol leakage or air ingress therebetween, other than through the opening 215.

Referring back to FIG. 7, the device 200 further comprises a power source 212 and two printed circuit boards 218*a*, 218*b* disposed within the holder 202. The power source 212 is in electrical communication with the first and second PCBs 218*a*, 218*b* and the static ignitor contacts 228 via wiring or other means for electrically coupling a variety of components. The first PCB 218*a* includes the electrical contacts 229 that contact the ignitor contacts 228 when the door assembly 289 is in the closed configuration, as described above. The first PCB 218*a* may further comprise the charging port 219. The second PCB 218*b* includes a spring-loaded ignitor push button 240 and an LED 241 that may illuminate during ignition and/or change colors to indicate a state of the device 200.

In the depicted implementation, the ignitor push button 240, when pressed by a user, activates the ignitor contacts 228 thereby igniting the heat source 220 of the cartridge 206. Specifically, once the push button 240 is actuated, the electrical circuit is completed and electricity is delivered to the ignitor contacts 228. In some implementations, the ignitor contacts 228 will only remain activated while the ignitor push button 240 is depressed. As such, in some implementations, the ignitor contacts 228 will be deactivated when the ignitor push button 240 is released. In some implementations, the ignitor push button 240 may be configured to activate the ignitor contacts 228 for a set time after release. In one implementation, the push button 240 is disposed proximate an opening 263 in the holder 202 with a button cover 240*a* covering the opening 263 and including a lens for viewing the LED. The button 240 is spring loaded so as to return to an off position after igniting the heat source.

The device 200 further includes a mouthpiece 204 removably secured to the holder 202. Specifically, the mouthpiece 204 has a first end configured to engage with a user's mouth and a longitudinally opposed second configured to removably and/or sealingly engage an opening in the proximal end of the holder 202, with a second aerosol passageway 254 extending longitudinally therebetween. Disposed generally between the holder 202 and the mouthpiece 204 is an optional insert 265 that may be permanently or removably coupled to the holder 202, mouthpiece 204, or both.

As shown in FIG. 6B, the main body of the holder 202 includes a tubular structure 221 disposed therein and extending along a length of the holder 202. The tubular structure 221 at least partially defines the first aerosol passageway 250 and extends towards the proximal end of the holder 202 and is configured to engage at least a portion of the mouthpiece 204 and/or insert 265 to provide fluid communication between the first and second aerosol passageways 250, 254 and deliver the aerosol to a user via the opening 258. In the depicted implementation, each of the first and second aerosol passageways 250, 254 has a central longitudinal axis 250*a*, 254*a*, where the central longitudinal axis 254*a* of the second aerosol passageway 254 is offset from the central longitudinal axis 250*a* of the first aerosol passageway 250 so that the first and second aerosol passageways define a unitary offset vapor path 243 from the distal end 202*b* of the main body to the first end 204*a* of the mouthpiece for passing an aerosol generated from the removable cartridge to a user.

The optional insert 265 is generally sized and shaped so as to be at least partially housed within a recess in the proximal end 202*a* of the holder and interface with the mouthpiece 104 via, for example, a retention mechanism 269. The insert 265 also defines a third aerosol passageway 253 that fluidly couples the first and second aerosol passageways 250, 254, thereby further defining the vapor path 243. In the depicted implementation, the insert 265 is inserted within the proximal end of the holder so that the tubular structure 221 extends through the third aerosol passageway 253. The mouthpiece 204 may be removable so that the insert 265 may be easily removed for cleaning or replacement to, for example, change an operating characteristic of the device. Alternatively, or additionally, the insert 265 may be removably secured in the holder 202 via at least one of complementary-threaded surfaces for a screw-type engagement, a press-fit engagement, a snap-fit engagement, a frictional engagement, or a magnetic engagement.

In the depicted implementation, the mouthpiece 204 is coupled to the holder 202 via the second end 204*b* thereof, which may be sized and shaped to engage an opening in the proximal end of the holder 202, such that a portion of the mouthpiece is disposed within the proximal end of the holder 202 and/or the insert 265, with or without a sealing mechanism. The mouthpiece 204 may be coupled to the holder 202 via an amount of frictional resistance sufficient to secure the mouthpiece 204 to the holder 202, but minimal enough so that a user may remove the mouthpiece 204 without significant effort. For example, the mouthpiece may be removed from the holder by, for example, application of a pulling or twisting action to the mouthpiece 204 or actuating a release. In some implementations, the holder 202 includes a retention structure disposed on a proximal end thereof and the second end 204*b* of the mouthpiece 204 defines a portion of the retention structure 269 configured to engage a mating portion of the retention structure on the holder 202. The retention structure 269 may be a snap-fit mechanism or other type of reversible coupling mechanism. The retention structure 269 may further removably secure the mouthpiece 204 to the holder 202.

FIGS. 10A-10C illustrate the general operation (e.g., loading and ejecting of the cartridge (i.e., consumable)) of the device 200. Specifically, FIG. 10A depicts the door assembly 289 substantially closed, but where the door assembly has been pushed downwardly or distally by, for example, a user's thumb to begin transitioning the door assembly 289 into its open configuration. As noted above, in the closed configuration, the door assembly 289 encloses the receiving chamber 210 within the holder 202 and orients the receiving chamber and the first aerosol passageway 250 into fluid communication. At a certain point, the door assembly is released from the holder and pivots into the fully open configuration as shown in FIG. 10B, either by continued pushing or via a biasing mechanism (e.g., a compression spring or other resilient member) that pushes the door assembly 289 outwardly so as to rotate about the pivot pin 284, and in some cases, both.

As shown in FIG. 10B, the door assembly 289 is biased into the open configuration, thereby exposing the chassis 224 and the receiving chamber 210 disposed therein. As further shown, the cartridge 206 is inserted into the receiving chamber 210 with the ignitable heat source 220 end inserted first. Once the cartridge 206 is loaded, the door assembly 289 is pushed closed (the biasing force is small enough that a user may close the door assembly with a single finger) and reengages the holder 202 to secure the door assembly 289 into the closed configuration as shown in FIG. 6A. In the closed configuration, the cartridge 206 is secured within the holder so as to be in fluid communication with the first aerosol passageway 250 (see FIG. 6B). The ignitable heat source 220 is in contact with the ignitor contacts 228 via the biasing mechanism 242 and may be ignited so that the cartridge may be consumed (i.e., aerosol generated and delivered to the user via the aerosol passageways).

While in the open configuration, the cartridge 206 may be ejected from the device 200 as shown in FIG. 10C. Specifically, the device 200 may be turned upside-down, which allows the cartridge to fall out of the receiving chamber 210. After ejection, a user may insert a new cartridge or simply close the door assembly 289 and store the device for later use. In some implementations, the device 200 may include a latching mechanism (not shown) configured to further secure the access door assembly 289 in the closed configuration. In some implementations, the latching mechanism may include a magnetic engagement, a threaded interface, a snap-fit, a detent, and/or be spring-loaded into the closed configuration.

FIGS. 11A, 111B, 12A, 14A, and 14B illustrate another example implementation of an aerosol delivery device 300. In particular, FIGS. 11A and 11B illustrate a perspective view and a cross-sectional side view, respectively, of an aerosol delivery device 300 that includes another static ignitor contact arrangement 328. Specifically, the aerosol delivery device 300 comprises a holder 302 having a main body defining a proximal end 302*a* and a distal end 302*b*, where the holder 302 further defines a receiving chamber 310 configured to receive a removable cartridge 306 and a first aerosol passageway 350 that extends through at least a portion of the main body. The removable cartridge 306 comprises an ignitable heat source 320 and a substrate portion 322 that includes a substrate material having an aerosol precursor composition configured to form an aerosol upon application of heat thereto. The device 300 further includes a mouthpiece 304 removably secured to the holder 302 as described in greater detail below.

As further illustrated by the exploded view of FIG. 12A, the device 300 includes an inner housing 324 disposed within the holder 302 and further defining the receiving chamber 310 and an opening 338 for receiving the cartridge 306. A proximal end of the inner housing 324 includes a retention mechanism 369*a* configured to engage with the mouthpiece 304 as described below. The inner housing 324 includes a tubular structure 321 disposed therein and extending along a length of the housing 324. The tubular structure defines the first aerosol passageway 350 and extends partially beyond the proximal end of the inner housing 324 and is configured to engage at least a portion of the mouthpiece 304 to provide fluid communication between the first and second aerosol passageways 350, 354 and deliver the aerosol to a user via an opening 358 in the mouthpiece 304. The holder 302 further comprises an access door 388 that may be slidingly or hingedly coupled to the holder 302 and configured to be opened for loading the cartridge 306 into the receiving chamber 310 via the opening 338 in the inner housing 324.

The receiving chamber 310 of the device 300 is further defined by an end cap 314 engaged with the distal end 302*b* of the holder 302 and defining an opening 315 configured to pass the removable cartridge 306 therethrough when ejected. An ejector (or actuator) assembly 308 is slidably disposed within the main body of the holder 302 and configured to eject the cartridge 306 when slid forward towards the distal end of the holder 302. In some implementations, the ejector assembly 308 is spring-loaded so as to return the ejector assembly 308 to a neutral position.

The device 300 further includes a power source 312 and a PCB 318 disposed within the inner housing 324. The power source 312 is in electrical communication with the PCB 318 and a pair of static ignitor contacts 328 disposed thereon that may be energized via a push button 340 disposed on a side wall of the holder 302. Specifically, once the push button 340 is actuated, the electrical circuit is completed and electricity is delivered to the ignitor contacts 328. The PCB 318 may further comprise a charging port 319 that is oriented on the PCB so as to be disposed at one end of the holder 302.

The pair of static ignitor contacts 328 are disposed proximate the distal end 302*b* of the holder and configured to be engaged with the ignitable heat source when the removable cartridge 306 is secured within the receiving chamber 310. The ignitor contacts 328 are coupled to the PCB 318 via a pair of contact arms 326 that allow the contacts 328 to flex outwardly via insertion of the cartridge 306 so that they contact the ignitable heat source 320 of the cartridge after loading. As shown in greater detail in FIG. 12B, each ignitor contact 328 is formed from a flat strip of metal (e.g., copper, silver, gold, or other conductive material) bent or otherwise shaped to form a corresponding shape configured to at least partially engage the ignitable heat source 320, thereby securing the cartridge 306 in place. The contacts 328 are physically and electrically coupled to the PCB 318 and, by extension, the power source 312. The ignitor contacts 328 may be flexibly coupled to the PCB 318 to allow them to flex slightly to receive the cartridge therebetween (e.g., via gap 399). Additionally, that flexibility will also assist with ejecting the cartridge from the device, as described in greater detail below.

FIGS. 13A and 13B depict an alternative configuration of the static ignitor contacts 328'. Each of the contacts 328' comprises an elongate body 325' formed from a single flat strip or heavy gauge wire of metal (e.g., copper, silver, gold, or other conductive material) where one end is configured to form the ignitor contact 328, while the other end is bent to form a contact arm 326' configured to engage the PCB 318'. The ignitor contacts 328' are configured such that each contact arm 326' extends upwardly and outwardly from the PCB in a generally symmetrical orientation to define a gap 399' for receiving the ignitable heat source portion of the cartridge 306. The cross-sectional view of FIG. 13A depicts one contact 328' oriented towards an inner surface of the receiving cavity 310' proximate the distal end of the device 300', with the other contact 328 essentially mirror image thereto. The bend in the elongate body 325' provides a spring force to bias the ignitor contacts 328 into contact with the ignitable heat source to secure the cartridge within the receiving chamber. In some implementations, the cartridge 306 may be further removably secured within the receiving chamber 310 via any of the mechanisms or manners disclosed herein (e.g., frictionally engaged via an elastomeric seal).

Referring back to FIGS. 11A, 111B, and 12A, the mouthpiece 304 has a first end 304*a* and a longitudinally opposed second end 304*b* with a second aerosol passageway 354 extending longitudinally therebetween. In the depicted implementation, the mouthpiece 304 is located at the proximal end of the holder 302, with the first end 304*a* configured to engage with a user's mouth and the second end 304*b* configured to engage the proximal end of the holder 302. The mouthpiece 304 is configured to sealingly engage with the holder 302 so that the first and second aerosol passageways 350, 354 are in fluid communication so as to deliver the aerosol generated in the receiving chamber to the user.

In the depicted implementation, the removable mouthpiece 304 comprises a hollow body 356 (i.e., recess) and a stem 305 (or similar tubular structure) disposed within the hollow body 356 and extending from the first end 304*a* to the second end 304*b*. The stem 305 defines the second aerosol passageway 354 extending therethrough and is engaged with the inner housing 324 so as to fluidly couple with the aerosol passageway 350 of the inner housing 324. The stem 305 may be coupled to the inner housing 324 via, for example, a press-fit or snap-fit engagement. In some implementations, the stem 305 is sealingly engaged with the first aerosol passageway 350 in the holder 302. For example, the stem 305 may include a sealing mechanism similar to any of those disclosed herein.

FIG. 12A further depicts the incorporation of an insert 365 into the proximal end of the mouthpiece 304. Specifically, the proximal end 304*a* of the mouthpiece 304 defines a receptacle 367 configured to secure the insert 365 therein. The insert 365 may be removably secured in the receptacle 367 via at least one of complementary-threaded surfaces for a screw-type engagement, a press-fit engagement, a snap-fit engagement, or a magnetic engagement. The insert 365 defines a cavity 371 in fluid communication with the second aerosol passageway 354 and the outlet 358 for delivering the aerosol to the user. Generally, the insert 365 allows for customization of the device 300 (e.g., different size outlets, aerosol conditioning, incorporation of a flavoring, etc.) and may be easily removed for cleaning or replacement.

In some implementations, the longitudinally opposed second end 304*b* is configured to engage an opening in the proximal end 302*a* of the holder via at least one of complementary-threaded surfaces for a screw-type engagement, a press-fit engagement, a snap-fit engagement, or a magnetic engagement. In other implementations, the mouthpiece 304 is removable secured to the holder 302 via a sealing mechanism that provides frictional resistance between the mouthpiece 304 and the holder 302 or other component therein. In some implementations, the inner housing 324 includes a retention structure 369*a* disposed on a proximal end thereof and the second end 304*b* of the mouthpiece 304 defines a mating retention structure 369*b* configured to engage the retention structure 369*a* on the inner housing 324. The retention structure (369 generally) may be a snap-fit mechanism or other type of reversible coupling mechanism. The retention structure 369 may further removably secure the mouthpiece 304 to the holder 302. The mouthpiece 304 can be removed from the holder 302 for, for example, cleaning or customization of the device 300 (e.g., the use of interchangeable mouthpieces) by, for example, application of a pulling or twisting action to the mouthpiece 304 or actuating a release.

FIGS. 14A and 14B illustrate the general operation (e.g., loading and ejecting of the cartridge (i.e., consumable)) of the device 300. Specifically, as shown in FIG. 14A, in order to load the cartridge 306 into the receiving chamber 310, the access door 388 is slid distally into the open configuration to expose the receiving chamber 310 via opening 338. The cartridge 306 is manually inserted into the receiving chamber 310 by "dropping" the cartridge 306 into the opening 338 and sliding it forward (e.g., pushed distally with a user's finger) so as to engage the ignitable heat source 320 with the static ignitor contacts 328. After loading, the door 388 is slid back into the closed configuration as shown in FIGS. 11A and 14B. The fit between the door 388 and the holder 302 is such that the cartridge 306 is in fluid communication with the first aerosol passageway 350 and there is no aerosol leakage or air ingress about the opening 338, with or without the use of additional sealing arrangements as described above.

FIG. 14B illustrates ejection of the cartridge 306. The ejector assembly 308 is slidably disposed within the main body of the holder 302, such that when the ejector assembly 308 is slid forward towards the distal end of the holder 302, the ejector assembly makes contact with the ignitor contacts 328 to release the ignitable heat source 320 therefrom.

Specifically, the ejector assembly comprises an inclined or wedge shaped body having a leading edge (308*a* in FIG. 12A), where the leading edge is oriented so as to be inserted between each of the ignitor contacts of the pair of static ignitor contacts 328 so as to deflect the ignitor contacts outwardly when the ejector assembly is advanced towards the distal end of the main body 302, thereby releasing the cartridge 306. The cartridge 306 may be pulled out of the distal end of the device and/or the device 300 may be angled downwardly to allow the cartridge to fall out. Generally, a spring force from the deflected ignitor contacts 328 returns the ejector assembly 308 to a neutral position once the cartridge is removed from between the ignitor contacts and the ejector is released. The spring force should be sufficient to push the wedge out from between the ignitor contacts 328 after the force applied to the ejector is removed; however, in some implementations, the ejector assembly 308 may be spring-loaded so as to return the ejector assembly 308 to the neutral position.

FIGS. 15A, 15B, 16, and 19A-19C illustrate another example implementation of an aerosol delivery device 400. In particular, FIGS. 15A and 15B illustrate a perspective view and a cross-sectional perspective view, respectively, of an aerosol delivery device 400 that includes another static ignitor contact arrangement 428. Specifically, the aerosol delivery device 400 comprises a holder 402 having a main body defining a proximal end 402*a* and a distal end 402*b*, where the holder 402 further defines a receiving chamber 410 configured to receive a removable cartridge 406 and a first aerosol passageway 450 that extends through at least a portion of the main body. The removable cartridge 406 comprises an ignitable heat source 420 and a substrate portion 422 that includes a substrate material having an aerosol precursor composition configured to form an aerosol upon application of heat thereto. The device 400 further includes a mouthpiece 404 secured to the holder 402 as described in greater detail below.

As further illustrated by the exploded view of FIG. 16, the device 400 includes an outer sleeve 403*a*, 403*b* disposed about the holder 402 that includes a first sleeve portion 403*a* and a second sleeve portion 403*b*. The first sleeve portion 403*a* may be slid over the proximal end 402*a* of the holder and may include an ignition push-button 440 described in greater detail below. The second sleeve portion 403*b* comprises an elongate body with an open side (e.g., a U-shaped cross-sectional shape) that covers a significant portion of the main body of the holder. The second sleeve 403*b* may attach to the holder 402 via a snap-fit and be configured to engage with a door 488. The door 488 may be hingedly coupled (e.g., via a piano-type or living hinge 484) to one side of the second sleeve 403*b* and movable between an open configuration (e.g., receiving chamber 410 exposed for loading the cartridge 406) and a closed configuration. In some implementations, the door 488 may sealingly engage with the sleeve 403*b* and/or holder the 402. In some implementations, the door 488 and the sleeve 403*b* are integrally formed. Additionally, the door 488 may be latched into the closed configuration via a magnetic engagement (485 in FIG. 18).

The holder 402 further defines the receiving chamber 410 and an opening 438 configured for receiving the cartridge 406. A sliding ejector or actuator assembly 408 is slidably disposed within the holder 402 as described below. In the closed configuration, the door 488 encloses the ejector assembly 408, which may prevent inadvertent ejection of the cartridge 406, or simply for aesthetic purposes. The holder 402 includes a structure or second retention mechanism 423 within the receiving chamber 410 that is configured to align, guide, and/or secure the cartridge 406 therein.

The mouthpiece 404 is located at the proximal end of the holder 402 and has a first end and a longitudinally opposed second end with a second aerosol passageway 454 extending longitudinally therebetween. In the depicted implementation, the first end of the mouthpiece 404 is configured to engage with a user's mouth and the second end is configured to engage the proximal end of the holder 402. The mouthpiece 404 is configured to sealingly engage with the holder 402 so that the first and second aerosol passageways 450, 454 are in fluid communication so as to deliver the aerosol generated in the receiving chamber 410 to the user via opening 458. The mouthpiece 404 may be removably coupled to the holder 402 to, for example, provide for cleaning or customization of the device 400. However, in other implementations, the mouthpiece 404 may be integrally formed with the holder.

The device 400 further includes a power source 412 and a PCB 418 disposed within the holder 402. The power source 412 is in electrical communication with the PCB 418 and the static ignitor contacts 428 via wiring or other means for electrically coupling a variety of components. The PCB 418 includes a pair of electrical contacts 429 that contact the ignitor contacts 428 when the door 488 is in the closed configuration. In some implementations, the electrical contacts 429 extend through a wall of the holder 402 so as to be accessible to the ignitor contacts 428, and may include a gasket or other sealing mechanism to seal the contacts 429 with the holder 402. See also FIGS. 17A, 17B, and 18.

In the depicted implementation, an ignitor push button (or switch generally) 440 is disposed in a side wall (or sleeve) of the holder 402 and configured, so that when pressed by a user, the ignitor contacts 428 are activated thereby igniting the heat source 420 of the cartridge 406. Specifically, once the push button 440 is actuated, the electrical circuit is completed and electricity is delivered to the ignitor contacts 428. In some implementations, the ignitor contacts 428 will only remain activated while the ignitor push button 440 is depressed. As such, in some implementations, the ignitor contacts 428 will be deactivated when the ignitor push button 440 is released. In some implementations, the ignitor push button 440 may be configured to activate the ignitor contacts 428 for a set time after release. In some implementations, the button 440 is spring loaded and may return to an off position after igniting the heat source. The device 400 may further include an LED ring 441 proximate the push button 440 that may illuminate during ignition and/or change colors to indicate a state of the device 400.

The door 488 includes an inner or first retention mechanism 489 coupled to or otherwise disposed on an inner surface of the door. The pair of static ignitor contacts 428 are secured between the door 488 and the retention mechanism 489. See also FIGS. 17A, 17B, and 18. The pair of static ignitor contacts 428 are disposed proximate the distal end 402*b* of the holder and configured to be engaged with the ignitable heat source 420 when the removable cartridge 406 is secured within the receiving chamber 410 and the door 488 in the closed configuration.

As shown in greater detail in FIG. 16, each ignitor contact 428 is formed from a flat strip of metal (e.g., copper, silver, gold, or other conductive material) bent or otherwise shaped to suit a particular application. In the depicted implementation, each contact 428 comprises an elongate body 425 formed from a single flat strip of metal where one end is curled or otherwise shaped to form the ignitor contact 428, while the other end remains substantially flat or slightly curved to form a contact arm 426 configured to engage the electrical contacts 429. The curved structures may provide a resiliency to the contact 428 and/or contact arm 426 to optimize their engagement with the ignitable heat source 420 or the electrical contacts 429, respectively. For example, the electrical contacts 428 may deflect slightly to receive the ignitable heat source 420 therebetween when the door 488 is closed securely.

FIGS. 17B and 18 depict the structure 423 in greater detail. In the depicted implementation, the structure 423 is a thickened portion of the holder wall that is sized and shaped to receive the cartridge. In some implementations, the structure 423 may comprise an open collar secured within the holder 402. In some implementations, an internal surface of the structure 423 is sized and shaped to provide a clearance or a snap-fit to the cartridge 406. As can also be seen in FIGS. 17B and 18, the electrical contacts 429 extend through the second retention structure 423 and are positioned to engage the contact arms 426, which extend through the retention mechanism 489 and electrically couple the ignitor contacts 428 with the power source 412. The electrical contacts 428 also extend through the retention mechanism 489 and are positioned to engage the ignitable heat source 420. The retention mechanism 489 may be attached to the door 488 via bonding, mechanical fasteners, snap-fit, etc. The retention mechanism 489 may be removably attached to the door 488 to allow for replacement of the ignitor contacts 428. The mechanism 489 may include a stand-off 489*a* configured to positively engage the cartridge 406 when the door 488 is in the closed configuration.

As further illustrated by the exploded view of FIG. 16, the ejector/actuator assembly 408 comprises a generally tubular slider body 430 disposable within the first aerosol passageway 450 of the holder 402, so as to slide along a length of the holder in a first direction and a second direction. The slider body 430 defines a recess 436 extending therethrough that forms a portion of the first aerosol passageway 450. The slider body 430 includes a first protrusion 331 extending from an outer surface thereof and extending through (or at least flush with) an opening 416 in a wall of the holder 402 that is configured to move the slider body 430 between a loading position (see FIG. 19A) and an ejecting position (see FIG. 19C). The slider body 430 further includes a second protrusion or inner stem 433 extending from a distal end thereof. The stem 433 is configured to engage the removable cartridge 406 so as to advance the removable cartridge through the distal end of the holder 402 when the ejector assembly 408 is moved into the ejecting position. Portions of the protrusions 431, 433 may extend into the receptacle 436 such that the vapor/air path splits around those portions. Specifically, one or more portions of the first protrusion, the second protrusion, or both may extend into a portion of the aerosol passageway defined by the receptacle 436 within the slider body 430 so that the aerosol generated by the cartridge 406 and pulled into the mouthpiece 404 is split by the one or more portions when traveling through the tubular body.

Additionally, the ejector assembly 408, specifically the slider body 430, includes a sealing arrangement for sealingly engaging with an internal surface of the first aerosol passageway 450 (e.g., to avoid aerosol leakage or undesirable air ingress). In the depicted implementation, the sealing arrangement comprises a pair of O-rings 460 disposed within grooves 461 disposed proximate the distal and proximal ends of the slider body 430. However, other configurations of the sealing arrangement are contemplated and considered within the scope of the disclosure. As further shown in FIG. 16, the device 400 includes a slider seal body 446 that is also disposable within the first aerosol passageway 450. The seal body 446 includes a pair of O-rings 460 disposed within grooves 461 disposed proximate the distal and proximal ends thereof. The distal end of the seal body 446 houses a third retention mechanism 476 therein that frictionally and/or sealingly engages with an outer surface of the cartridge 406 as described below. In the depicted implementation, the retention mechanism 476 is an O-ring.

The operation of the device 400 generally, and the ejector assembly 408 specifically, is described with respect to FIGS. 19A-19C. Specifically, FIG. 19A represents the cartridge 406 being loaded into the device 400 (i.e., the ejector assembly 406 in the loading position), FIG. 19B represents the device 400 during ignition and smoking, and FIG. 19C represents the cartridge 406 being ejected from the device 400 (i.e., the ejector assembly in the ejection position).

Referring to FIG. 19A, in order to load the cartridge 406 into the receiving chamber 410, the door 488 is pushed or "flipped" open, "breaking" the magnetic latching and exposing the receiving chamber 410 and the ejector assembly 408. The ejector assembly 408 is moved towards the proximal end of the device 400 to allow for full access to the receiving chamber 410 via the opening 438. As shown by the arrow, the cartridge 406 is manually inserted into the receiving chamber 410 by pressing the cartridge into a slot defined by the second retention structure 423 and slid into the third retention mechanism 476, so as to locate the cartridge 406 into a lighting and/or use positon, where the cartridge is sealingly secured within the chamber 410 via the retention mechanism 476 and the ignitable heat source 420 operatively aligned with the ignitor contacts 428.

After loading, the door 488 is moved to the closed configuration (e.g., snapped shut) so that the sealed end of the cartridge 406 is in fluid communication with the first aerosol passageway 450, the contact arms 426 and electrical contacts 429 are engaged, and the static ignitor contacts 428 engage the ignitable heat source 420, as shown in FIG. 19B (i.e., the lighting/use position). In particular, in the lighting/use position of the depicted implementation, the heat source 420 portion of the cartridge 406 is positioned proximate the distal end of the holder 402, aligned with the ignitor contacts 428, and proximate an opening 415 in the distal end of the device 400. The heat source 420 is ignited via the ignition push button 440 as described above. In some implementations, the opening 415 in the distal end allows for the ingress of air (e.g., via a user drawing on one end of the device for inhalation of an aerosol produced thereby), where the air drawn into the distal end of the device 400 (arrow A) provides oxygen to the ignited heat source 420. The air/oxygen may travel through the heat source 420 and combine with the aerosol generated from the substrate 422, and then be delivered to a user via the mouthpiece 404. More specifically, when a user draws on the holder 402 (e.g., via the mouthpiece 404), ambient air may be drawn into the device 400 via the opening 415, travel through the cartridge 406 where the air mixes with the aerosol produced by the cartridge, and then travels through the first and second aerosol passageways 450, 454 for delivery to the user via opening 458. Additionally, a user may be able to observe ignition via the opening 415. In other implementations not depicted, the holder may include one or more apertures therein for allowing entrance of ambient air to be directed into the receiving chamber and/or the aerosol passageway (such as, for example, through the substrate cartridge and/or downstream from the substrate cartridge).

In some implementations, the device 400 may include an ejector assembly as shown in FIG. 19C. Generally, the ejector assembly 408 is configured to eject the cartridge 406 from the distal end of the holder 402 via opening 415. The ejector assembly 408 is accessible with the door 488 in the open configuration. In one implementation, the ejector assembly 408 comprises a sliding body 430 as described above, where moving the slider protrusion 431 forward or distally moves the stem 433 forward or distally until it engages one end of the removable cartridge 406. Continued movement of the slider protrusion 431 forward causes the stem to advance the removable cartridge out of the receiving chamber 410 and out of the aerosol delivery device 400 through the opening 415. Specifically, a user can slide the ejector assembly 408 forward (i.e., away from the mouthpiece) using, for example, their thumb so that the inner stem 433 of the slider body 430 engages the cartridge 406 pushing it forward and disengaging the cartridge from the second and third retention mechanisms 423, 476. After which, the cartridge 406 may be pulled out of or allowed to drop out of the device 400. Alternatively, or additionally, the ejector assembly may include a toggle-type mechanism that is configured to release the cartridge from at least the second retention mechanism 423 upon the application of a downward force.

FIGS. 20A, 20B, and 21 illustrate another example implementation of an aerosol delivery device 500. In particular, FIGS. 20A and 20B illustrate a perspective view and a cross-sectional perspective view, respectively, of an aerosol delivery device 500 that includes a removable cartridge 506, a slider assembly 508, and a separate ignition actuator 540. The aerosol delivery device 500 includes a holder 502 defining a proximal end and a distal end. The holder 502 defines a receiving chamber 510 disposed therein and configured to receive a removable cartridge 506 comprising an ignitable heat source 520 and a substrate portion 522 that includes a substrate material having an aerosol precursor composition configured to form an aerosol upon application of heat thereto. The holder 502 also includes a pair of actuatable ignitor contacts 528 disposed proximate the distal end thereof and coupled thereto via a pair of contact arms 526. The actuatable ignitor contacts 528 are configured to be engaged with the ignitable heat source 520 when the removable cartridge 506 is secured within the receiving chamber 510 and when the actuatable ignitor contacts 528 are actuated by a user.

Additionally, the holder 502 includes a window 582 disposed therein and configured to provide a view of at least a portion of the receiving chamber 510 so that a user may observe the cartridge 506 and/or electrical contacts 528. All or a portion of the window 582 may comprise a transparent or translucent material (e.g., a glass material, a polycarbonate, polyethylene terephthalate, acrylic, or the like). In some implementations, a portion of the holder 502 may be made from a transparent or translucent material. The holder 502 also houses a power source 512, a PCB 518 with associated electronics, and the sliding actuator assembly 508. The sliding actuator assembly 508 is slidably disposed within the holder 502 and is configured to eject the removable cartridge from the holder 502. The holder 502 further defines a first aerosol passageway 550.

The device 500 further comprises a mouthpiece 504 having a first end 504*a* and a longitudinally opposed second end 504*b* with a second aerosol passageway 554 extending longitudinally therebetween. In the depicted implementation, the mouthpiece 504 is located at the proximal end of the holder 502, with the first end configured to engage with a user's mouth and the second end configured to engage the proximal end of the holder 502. The mouthpiece 504 is configured to sealingly engage with the holder 502 so that the first and second aerosol passageways 550, 554 are in fluid communication so as to deliver the aerosol generated in the receiving chamber to the user. The mouthpiece 504 may be removably coupled to the holder 502 to, for example, provide for cleaning or customization of the device 500.

The receiving chamber 510 in some implementations includes a bar 511 or other structure for supporting the window 582 and/or guiding the cartridge 506 during insertion. In the depicted implementation, the holder 502 includes a cut-out or other opening that exposes the receiving chamber 510 and is configured to receive the window 582 therein. The window 582 may be installed or otherwise coupled to the holder 502 via an adhesive, snap fit, or other means known in the art. The receiving chamber 510 includes a groove or other structure for securing a retention mechanism 576 therein that is configured to frictionally and/or sealingly engage an outer surface of the cartridge 506. In the depicted implementation, the retention mechanism 376 is an O-ring.

When in a lighting/use position, the distal end of the cartridge 506 is located proximate the distal end of the holder 502 such that the entire cartridge 506 is located inside of the receiving chamber 510. In particular, in the lighting/use position of the depicted implementation, the heat source 520 portion of the cartridge 506 is also positioned proximate the distal end of the holder 502 and aligned with the ignitor contacts 528 in the lighting position. The heat source 520 is ignited via the aligned push buttons 540 disposed on the opposite sides of the holder 502 of the aerosol delivery device 500. The buttons 540 are movably coupled to the lower body portion, with or without a sealing arrangement, so that a user may depress both buttons simultaneously (e.g., via a pinching action) so as to engage and deflect the contact arms 526 and by extension move the ignitor contacts 528 into contact with the ignitable heat source 520. Once released, the buttons 540 return to their original position, at least in part via a spring action from the deflected contact arms 526 and/or a return biasing element. The device 500 includes a pair of LEDs 541 that may illuminate during ignition and/or change colors to indicate a state of the device 500. Additionally, a user may be able to observe ignition via the window 582.

In the depicted implementations, the outer housing or holder may comprise a rigid material. For example, the holders 102, 202, 302, 402, 502 of the depicted implementations may be constructed of an aluminum material; however, in other implementations, the holders may be constructed of other materials, including other metal materials (such as, for example, stainless steel, aluminum, brass, copper, silver, gold, bronze, titanium, various alloys, etc.), or graphite materials, or ceramic materials, or plastic materials, or any combinations thereof. In some implementations, at least a portion of the heat source and/or at least a portion of the substrate material may be circumscribed by a paper foil laminate. In some implementations, the cartridge may comprise an enclosure comprising a laminate that contains a heat source and a beaded substrate material. Some examples of laminates and/or enclosures that may be applicable to the present disclosure can be found in U.S. Pat. App. Pub. No. 2020/0128880 to Gage et al., which is incorporated herein by reference in its entirety. Other examples of cartridges are described herein below with respect to FIGS. 22 and 23.

In some implementations, the holder (or any components thereof) may be made of moldable plastic materials such as, for example, polycarbonate, polyethylene, acrylonitrile butadiene styrene (ABS), polyamide (Nylon), or polypropylene. In other implementations, the holder may be made of a different material, such as, for example, a different plastic material, a metal material (such as, but not limited to, stainless steel, aluminum, brass, copper, silver, gold, bronze, titanium, various alloys, etc.), a graphite material, a glass material, a ceramic material, a natural material (such as, but not limited to, a wood material), a composite material, or any combinations thereof. The holders may be formed via extrusion. As noted above, the mouthpiece portion of some implementations is separable from the main body, while in other implementations, the mouthpiece portion may be integral with the main body. In any event, the mouthpiece portion and the main body may be made of the same material or different materials. In various implementations comprising a separable mouthpiece portion, the mouthpiece portion may be coupled to the main body in a variety of ways, including, for example, via one or more of a snap-fit, interference fit, screw thread, magnetic, and/or bayonet connection. In other implementations, the mouthpiece portion may be integral with the main body and thus may not be separable.

In the depicted implementations, the holder includes walls that are substantially solid and non-porous; however, in other implementations one or more of these walls of a holder may have other configurations. For example, in some implementations one or more of the walls of a holder may be non-solid and/or substantially porous or may include one or more non-solid and/or substantially porous portions. In some implementations, for example, the holder may include one or more apertures that may facilitate access of oxygen to the heat source. Alternatively, or additionally, other implementations may include one or more apertures that may mix with the aerosol generated during a draw. In such a manner, in the use position the one or more apertures may be located proximate the heat source, thus providing the heat source with additional access to oxygen during combustion. In some implementations, the holder may include one or more apertures downstream from the heat source. For example, in some implementations the holder may include apertures that extend into the aerosol passage of the holder that may mix with aerosol generated by the substrate material of the cartridge.

As described above, the holder of various implementations of the present disclosure includes a lighting/use position. In some implementations, the holder may also have an extinguishment position. In such a manner, the extinguishment position may be configured such that the heat source of a cartridge is deprived of sufficient oxygen to sustain combustion. In some implementations, the extinguishment position may be obtained by a further action of the holder. In other implementations, one or more additional features may be included such that an extinguishment position may be achieved by translating the one or more additional features. In particular, the holder of one implementation may include an air impermeable cover feature located proximate the distal end of the holder that may be mechanically or manually actuatable (e.g., by rotating the cover feature over the end of the main body and/or by sliding the cover feature across the end of the main body) such that in the extinguishment position, the cover feature substantially covers the open end of the holder and the heat source of the cartridge is deprived of sufficient oxygen to sustain combustion. In another implementation, the holder may include a detachable feature, such as, for example, an end cap, that may be used to achieve the extinguishment position. For example, in some implementations a separate end cap may be attachable over the distal end of the holder such that, once attached, the heat source of the cartridge is deprived of sufficient oxygen to sustain combustion. Such an end cap could also be used to cover the end of the second body portion when not in use, such as, for example, to prevent dirt and/or foreign objects from entering into the device. Additionally, or alternatively, in some implementations the holder of the present disclosure may include an air permeable cover feature (e.g., a cover feature comprising a plurality of openings or a cover feature comprising a mesh) that protects the heat source of the cartridge in the lighting/use position. For example, the holder of one implementation may include an air permeable cover feature located proximate the distal end of the holder that may be mechanically or manually actuatable (e.g., by rotating the cover feature over the end of the holder and/or by sliding the cover feature across the end of the holder) such that once ignited, the cover feature may be actuated to substantially cover the open end of the holder while maintaining sufficient access of oxygen to the heat source.

In various implementations, a removable cartridge may have other configurations for use with a holder of the present disclosure. For example, FIG. 22 illustrates a perspective view of a removable cartridge 606, according to another example implementation of the present disclosure. In the depicted implementation, the cartridge 606 defines a proximal end 690 and a distal end 692. The cartridge 606 of the depicted implementation further includes an ignitable heat source 620, which comprises a fuel element 694, a substrate portion 622, which comprises a substrate material 696 (see FIG. 23), and an outer housing 698 configured to circumscribe at least a portion of the ignitable heat source 620 and the substrate material 622. It should be noted that although in the depicted implementation the cartridge 606 has a substantially cylindrical overall shape, in various other implementations, the cartridge or any of its components may have a different shape. For example, in some implementations the cartridge (and/or any of its components) may have a substantially rectangular shape, such as a substantially rectangular cuboid shape. In other implementations, the cartridge (and/or any of its components) may have other hand-held shapes. Some examples of cartridge configurations that may be applicable to the present disclosure can be found in U.S. Pat. App. Pub. No. 2021/0015173 to Cox et al., which is incorporated herein by reference in its entirety.

In some implementations, a barrier may exist between the heat source and the substrate material. In some implementations, such a barrier may comprise a disc that may include one or more apertures therethrough. In some implementations, the barrier may be constructed of a metal material (such as, for example, stainless steel, aluminum, brass, copper, silver, gold, bronze, titanium, various alloys, etc.), or a graphite material, or a ceramic material, or a plastic material, or any combinations thereof. In some implementations, a heat transfer component, which may or may not comprise a barrier, may exist between the heat source and the substrate material. Some examples of heat transfer components are described in U.S. Pat. App. Pub. No. 2019/0281891 to Hejazi et al., which is incorporated herein by reference in its entirety. In some implementations, a barrier and/or a heat transfer component may prevent or inhibit combustion gasses from being drawn through the substrate material (and/or from being drawn through air passageways through which aerosol is drawn).

In various implementations, the heat source may be configured to generate heat upon ignition thereof. In the depicted implementation, the ignitable heat source 620 comprises a combustible fuel element 694 that has a generally cylindrical shape and that incorporates a combustible carbonaceous material. In other implementations, the heat source may have a different shape, for example, a prism shape having a cubic or hexagonal cross-section. Carbonaceous materials generally have a high carbon content. Some carbonaceous materials may be composed predominately of carbon, and/or typically have carbon contents of greater than about 60 percent, generally greater than about 70 percent, often greater than about 80 percent, and frequently greater than about 90 percent, on a dry weight basis.

In some instances, the heat source may incorporate elements other than combustible carbonaceous materials (e.g., tobacco components, such as powdered tobaccos or tobacco extracts; flavoring agents; salts, such as sodium chloride, potassium chloride and sodium carbonate; heat stable graphite a hollow cylindrical (e.g., tube) fibers; iron oxide powder; glass filaments; powdered calcium carbonate; alumina granules; ammonia sources, such as ammonia salts; and/or binding agents, such as guar gum, ammonium alginate and sodium alginate). In other implementations, the heat source may comprise a plurality of ignitable objects, such as, for example, a plurality of ignitable beads. It should be noted that in other implementations, the heat source may differ in composition or relative content amounts from those listed above. For example, in some implementations different forms of carbon could be used as a heat source, such as graphite or graphene. In other implementations, the heat source may have increased levels of activated carbon, different porosities of carbon, different amounts of carbon, blends of any above mentioned components, etc. In still other implementations, the heat source may comprise a non-carbon heat source, such as, for example, a combustible liquefied gas configured to generate heat upon ignition thereof. For example, in some implementations, the liquefied gas may comprise one or more of petroleum gas (LPG or LP-gas), propane, propylene, butylenes, butane, isobutene, methyl propane, or n-butane. In still other implementations, the heat source may comprise a chemical reaction based heat source, wherein ignition of the heat source comprises the interaction of two or more individual components. For example, a chemical reaction based heat source may comprise metallic agents and an activating solution, wherein the heat source is activated when the metallic agents and the activating solution come in contact. Some examples of chemical based heat sources can be found in U.S. Pat. No. 7,290,549 to Banerjee et al., which is incorporated herein by reference in its entirety. Combinations of heat sources are also possible. Although specific dimensions of an applicable heat source may vary, in the depicted implementation, the ignitable heat source 620 has a length in an inclusive range of approximately 1 mm to approximately 20 mm, and in some implementations may be approximately 12 mm, and an overall diameter in an inclusive range of approximately 3 mm to approximately 8 mm, and in some implementations may be approximately 4.8 mm (and in some implementations, approximately 7 mm).

Although in other implementations the heat source may be constructed in a variety of ways, in the depicted implementation, the ignitable heat source 620 is extruded or compounded using a ground or powdered carbonaceous material, and has a density that is greater than about 0.5 g/cm$^3$, often greater than about 0.7 g/cm$^3$, and frequently greater than about 1 g/cm$^3$, on a dry weight basis. See, for example, the types of fuel source components, formulations and designs set forth in U.S. Pat. No. 1,551,451 to Riggs et al. and U.S. Pat. No. 7,836,897 to Borschke et al., which are incorporated herein by reference in their entireties.

In various implementations, the heat source may have a variety of forms, including, for example, a substantially solid cylindrical shape or a hollow cylindrical (e.g., tube) shape. In other implementations, the heat source may comprise a plurality of hollow or substantially solid spheres, which in some implementations may comprise substantially the same size, and in other implementations may comprise more than one size. In various implementations, the heat source may be made in variety of ways, including, but not limited to, via extrusion, injection molding, compression molding, etc. The ignitable heat source 620 of the depicted implementation comprises an extruded monolithic carbonaceous material that has a generally cylindrical shape that includes a plurality of internal passages 691 extending longitudinally from a first end of the ignitable heat source 620 to an opposing second end of the ignitable heat source 620. In the depicted implementation there are approximately thirteen internal passages 691 comprising a single central internal passage 691*a*, six surrounding internal passages 680*b*, which are spaced from the central internal passages 691*a* and have a similar size (e.g., diameter) to that of the central internal passage 691*a*, and six peripheral internal passages 691*c*, which are spaced from an outer surface of the ignitable heat source 620 and are smaller in diameter than that of the central internal passage 691*a*. It should be noted that in other implementations, there need not be a plurality of internal passages and/or the plurality of internal passages may take other forms and/or sizes. For example, in some implementations, there may be as few as two internal passages, and still other implementations may include as few as a single internal passage. Still other implementations may include no internal passages at all. Additional implementations may include multiple internal passages that may be of unequal diameter and/or shape and which may be unequally spaced and/or located within the heat source.

Some implementations may alternatively, or additionally, include one or more peripheral grooves that extend longitudinally from a first end of the heat source to an opposing second end, although in other implementations the grooves need not extend the full length of the heat source. In some implementations, such grooves may be substantially equal in width and depth and may be substantially equally distributed about a circumference of the heat source. In such implementations, there may be as few as two grooves, and still other implementations may include as few as a single groove. Still other implementations may include no grooves at all. Additional implementations may include multiple grooves that may be of unequal width and/or depth, and which may be unequally spaced around a circumference of the heat source. In still other implementations, the heat source may include flutes and/or slits extending longitudinally from a first end of the extruded monolithic carbonaceous material to an opposing second end thereof. In some implementations, the heat source may comprise a foamed carbon monolith formed in a foam process of the type disclosed in U.S. Pat. No. 7,615,184 to Lobovsky, which is incorporated herein by reference in its entirety. As such, some implementations may provide advantages with regard to reduced time taken to ignite the heat source. In some other implementations, the heat source may be co-extruded with a layer of insulation (not shown), thereby reducing manufacturing time and expense. Other implementations of fuel elements include carbon fibers of the type described in U.S. Pat. No. 4,922,901 to Brooks et al. or other heat source implementations such as is disclosed in U.S. Pat. App. Pub. No. 2009/0044818 to Takeuchi et al., each of which is incorporated herein by reference in its entirety. Further examples of heat sources including debossed heat source systems, methods, and smoking articles that include such heat sources are disclosed in U.S. Pat. App. Pub. No. 2019/0254335 to Spicer et al., which is incorporated herein by reference in its entirety.

Generally, the heat source is positioned sufficiently near an aerosol delivery component (e.g., the substrate portion) having one or more aerosolizable components so that the aerosol formed/volatilized by the application of heat from the heat source to the aerosolizable components (as well as any flavorants, medicaments, and/or the like that are likewise provided for delivery to a user) is deliverable to the user by way of the mouthpiece. That is, when the heat source heats the substrate component, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof. Additionally, the selection of various smoking article elements is appreciated upon consideration of commercially available electronic smoking articles, such as those representative products listed in the background art section of the present disclosure.

FIG. 23 illustrates a longitudinal cross-section view of the cartridge 606 of FIG. 22. As shown in the figure, the substrate material 622 of the depicted implementation has opposed first and second ends, with the ignitable heat source 620 disposed adjacent the first end of the substrate material 622. Although dimensions and cross-section shapes of the various components of the cartridge may vary due to the needs of a particular application, in the depicted implementation the cartridge 606 may have an overall length in an inclusive range of approximately 10 mm to approximately 10 mm and a diameter in an inclusive range of approximately 2 mm to approximately 20 mm. In addition, in the depicted implementation the outer housing 698 may have a thickness in the inclusive range of approximately 0.05 mm to 0.5 mm. Furthermore, in the depicted implementation the substrate portion 610 may have a length in the inclusive range of approximately 1 mm to 30 mm and a diameter slightly less than that of the overall cartridge in order to accommodate the thickness of the housing 698, such as, for example, a diameter in an inclusive range of approximately 2.9 mm to approximately 9.9 mm. In the depicted implementation, the substrate material 622 comprises tobacco beads, which may have diameter sizes in range of approximately 0.5 mm to 2.0 mm, although in other implementations the size may differ. In other implementations, the substrate material may be a granulated tobacco material or cut filler tobacco. Although other implementations may differ, in the depicted implementation the outer housing 698 of the cartridge 606 is filled to about 80-90% capacity to allow for insertion of the fuel element 694.

In the depicted implementation, the substrate portion 622 comprises a substrate material 696 having a single segment, although in other implementations the substrate portion may include one or more additional substrate material segments. For example, in some implementations, the aerosol delivery device may further comprise a second substrate material segment (not shown) having opposed first and second ends. As described above, in various implementations, one or more of the substrate materials may include a tobacco or tobacco related material, with an aerosol precursor composition associated therewith. In other implementations, non-tobacco materials may be used, such as a cellulose pulp material. In other implementations, the non-tobacco substrate material may not be a plant-derived material. Other possible compositions and/or components for use in a substrate material (and/or substrate materials) are described above. Reference is also made to the discussion above regarding various possible shapes, aerosol precursor FIGS. 22 and 21, the outer housing 698 of the cartridge 606 of the depicted implementation is configured to circumscribe at least a portion of the substrate portion 622, including the substrate material 696. In the depicted implementation, the outer housing 698 is also configured to circumscribe a portion of the ignitable heat source 620. In some implementations, the outer housing may circumscribe the entire heat source. In the depicted implementation, the outer housing comprises a rigid material. For example, the outer housing 698 of the depicted implementation is constructed of an aluminum material; however, in other implementations the outer housing may be constructed of other materials, including other metal materials (such as, for example, stainless steel, aluminum, brass, copper, silver, gold, bronze, titanium, various alloys, etc.), or graphite materials, or ceramic materials, or plastic materials, or any combinations thereof. In some implementations, at least a portion of the heat source and/or at least a portion of the substrate material may be circumscribed by a paper foil laminate. In some implementations, the cartridge may comprise an enclosure comprising a laminate that contains a heat source and a beaded substrate material. Some examples of laminates and/or enclosures that may be applicable to the present disclosure can be found in U.S. Pat. App. Pub. No. 2020/0128880 to Gage et al., which is incorporated herein by reference in its entirety.

In the depicted implementation, the outer housing 698 is constructed as a tube structure that substantially encapsulates the substrate material 622; however, as noted above, in other implementations the outer housing may have other shapes. Although the shape of the outer housing may vary, in the depicted implementation the outer housing 698 comprises a tube structure having an open end and a closed end. The depicted implementation of the outer housing 698 also includes one or more end apertures 693 located on the closed end of the outer housing 698 that are configured to allow aerosolized vapor (herein alternatively referred to as a "vapor" or "aerosol") to pass therethrough. The end apertures 693 of the depicted implementation are in the form of a pair of elongate rounded slots; however, in other implementations the end apertures may have any form that permits passage of the aerosol therethrough. As such, it will be appreciated that the end apertures 693 can comprise fewer or additional apertures and/or alternative shapes and sizes of apertures than those illustrated.

In various implementations, the present disclosure may also be directed to kits that provide a variety of components as described herein. For example, a kit may comprise a holder with one or more cartridges. In another implementation, a kit may comprise a plurality of holders. In further implementations, a kit may comprise a plurality of cartridges. In yet another implementation, a kit may comprise a plurality of holders and a plurality of cartridges. The inventive kits may further include a case (or other packaging, carrying, or storage component) that accommodates one or more of the further kit components. The case could be a reusable hard or soft container. Further, the case could be simply a box or other packaging structure. In some implementations, a brush or other cleanout accessory may be included in a kit. The cleanout accessory may be configured to be inserted in a cartridge receiving chamber of the holder, or, in other implementations, inserted in a separate aperture that enables a user to remove debris from the cartridge receiving chamber and/or ignitor contacts.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

What is claimed is:

1. An aerosol delivery device comprising:

a holder comprising a main body defining a proximal end and a distal end, the main body further defining a receiving chamber configured to receive a removable cartridge comprising an ignitable heat source, the main body further defining a first aerosol passageway that extends through at least a portion of the main body;

an access door coupled to the holder and configured to be movable between an open configuration and a closed configuration, wherein in the open configuration, the receiving chamber is at least partially exposed for loading of the removable cartridge; and a static ignitor contact disposed on or in the access door and oriented to contact the ignitable heat source when the removable cartridge is secured within the receiving chamber and the access door is in the closed configuration.

2. The aerosol delivery device of claim 1, further comprising a power source disposed within the main body, wherein the static ignitor contact is in electrical communication with the power source when the door is in the closed configuration.

3. The aerosol delivery device of claim 1, wherein the static ignitor contact comprises a pair of static ignitor contacts oriented so as to contact the ignitable heat source at, at least two points when the removable cartridge is secured within the receiving chamber and the access door is in the closed configuration.

4. The aerosol delivery device of claim 3, wherein the pair of static ignitor contacts are disposed on an inner surface of the access door.

5. The aerosol delivery device of claim 2, wherein the holder comprises at least one electrical contact in electrical communication with the power source and configured to mate with the static ignitor contact when the access door is in the closed configuration to complete an electrical circuit.

6. The aerosol delivery device of claim 5, wherein at least one of the electrical contact comprises a pogo pin.

7. The aerosol delivery device of claim 5, wherein the static ignitor contact comprises an elongate body with a first contact portion disposed at a distal end thereof and configured to engage the ignitable heat source and a second contact portion disposed at a proximal end of the elongate body and configured to engage the at least one electrical contact.

8. The aerosol delivery device of claim 2 further comprising an ignition switch disposed on the holder and in electrical communication with the power source and the static ignitor contact when the access door is in the closed configuration, the ignition switch configured to deliver electrical current to the static ignitor contact when actuated.

9. The aerosol delivery device of claim 2 further comprising a printed circuit board disposed within the holder and in electrical communication with the power source and comprising a controller.

10. The aerosol delivery device of claim 5, wherein the electrical circuit is disrupted when the access door is in the open configuration.

11. The aerosol delivery device of claim 1, wherein the access door is pivotably coupled to the main body.

12. The aerosol delivery device of claim 1, wherein the access door is hingedly coupled to the main body.

13. The aerosol delivery device of claim 1, wherein the access door is coupled to the main body via a detent hinge configured maintain the access door in at least one of the open configuration or the closed configuration.

14. The aerosol delivery device of claim 1, wherein the access door sealingly engages the main body in the closed configuration.

15. The aerosol delivery device of claim 1, wherein the access door further comprises an inner housing defining the receiving chamber, wherein the access door is configured to orient the receiving chamber in fluid communication with the first aerosol passageway when in the closed configuration.

16. The aerosol delivery device of claim 1 further comprising a latching mechanism configured to secure the access door in the closed configuration.

17. The aerosol delivery device of claim 1, wherein the access door is substantially flush with an outer surface of the holder when in the closed configuration.

18. The aerosol delivery device of claim 1 further comprising an actuator assembly configured to release the access door from the closed configuration.

19. The aerosol delivery device of claim 1, wherein the access door includes an insert disposed therein and configured to receive the cartridge and provide thermal insulation thereto.

20. The aerosol delivery device of claim 1 further comprising a biasing mechanism disposed within the holder and oriented to engage a removable cartridge secured within the receiving chamber, wherein the biasing mechanism urges the ignitable heat source of the cartridge into contact with the static ignitor contact when the access door is in the closed configuration.

21. The aerosol delivery device of claim 1 further comprising a seal assembly disposed within the receiving chamber and configured to removably secure the removable cartridge therein.

22. The aerosol delivery device of claim 1 further comprising a mouthpiece including a first end and a longitudinally opposed second end with a second aerosol passageway extending longitudinally therebetween, wherein the first end is configured to engage with a user's mouth and the second end is configured to engage the proximal end of the holder.

23. The aerosol delivery device of claim 22, wherein the mouthpiece is removably coupled to the holder.

24. The aerosol delivery device of claim 22, wherein the access door defines an opening in a distal end thereof, the opening configured to provide air to the ignited heat source.

25. The aerosol delivery device of claim 1 further comprising the removable cartridge, wherein the cartridge includes a substrate material having an aerosol precursor composition configured to form an aerosol upon application of heat thereto.

26. The aerosol delivery device of claim 1 further comprising a sliding actuator assembly coupled to the holder and configured to eject the removable cartridge.

27. The aerosol delivery device of claim 26, wherein the sliding actuator assembly comprises:

a tubular body defining a portion of the first aerosol passageway and configured to slide along a portion of the main body in a first direction and a second direction;

a first protrusion extending from an outer surface of the tubular body and configured to extend through an opening in a wall of the main body to provide for moving the tubular body in the first and second directions;

a second protrusion extending from a distal end of the tubular body and configured to engage the removable cartridge so as to advance the removable cartridge through the distal end of the main body when the tubular body is moved in the first or second direction.

28. The aerosol delivery device of claim 26, wherein the sliding actuator further comprises a sealing arrangement for sealingly engaging an internal surface of the main body.

* * * * *